US011725357B2

(12) United States Patent
Stroyer

(10) Patent No.: US 11,725,357 B2
(45) Date of Patent: Aug. 15, 2023

(54) DEFORMED PILE SHAFT FOR PROVIDING GRIPPING CONTACT WITH A SUPPORTING MEDIUM AND RESISTING THE SUPPORTING MEDIUM FROM SHEARING

(71) Applicant: Benjamin G. Stroyer, East Rochester, NY (US)

(72) Inventor: Benjamin G. Stroyer, East Rochester, NY (US)

( * ) Notice: Subject to any disclaimer, the term of this patent is extended or adjusted under 35 U.S.C. 154(b) by 202 days.

(21) Appl. No.: 17/366,573

(22) Filed: Jul. 2, 2021

(65) Prior Publication Data

US 2022/0042267 A1 Feb. 10, 2022

Related U.S. Application Data

(63) Continuation-in-part of application No. 16/658,830, filed on Oct. 21, 2019, now abandoned.

(60) Provisional application No. 62/748,493, filed on Oct. 21, 2018.

(51) Int. Cl.
*E02D 5/48* (2006.01)
*E02D 5/24* (2006.01)

(52) U.S. Cl.
CPC ..... *E02D 5/48* (2013.01); *E02D 5/24* (2013.01)

(58) Field of Classification Search
CPC combination set(s) only.
See application file for complete search history.

(56) References Cited

U.S. PATENT DOCUMENTS

| | | | |
|---|---|---|---|
| 109,337 | A | 11/1870 | Moseley |
| 935,081 | A | 9/1909 | Wolfsholz |
| 1,307,160 | A | 6/1919 | Stokes |
| 2,911,239 | A | 11/1959 | Marzolf, Sr. |
| 3,243,962 | A | 4/1966 | Ratliff |
| 3,690,109 | A | 9/1972 | Turzillo |
| 3,875,751 | A | 4/1975 | Paus |
| 3,969,902 | A | 7/1976 | Ichise et al. |
| 4,072,017 | A | 2/1978 | Shiraki |
| 4,360,599 | A | 11/1982 | Loken et al. |
| 4,504,173 | A | 3/1985 | Feklin |
| 4,533,279 | A | 8/1985 | van den Elzen et al. |
| 4,659,259 | A | 4/1987 | Reed et al. |
| 5,219,246 | A | 6/1993 | Coutts et al. |
| 5,378,085 | A | 1/1995 | Kono et al. |

(Continued)

FOREIGN PATENT DOCUMENTS

| | | |
|---|---|---|
| CN | 201843129 | 5/2011 |
| JP | 05086791 | 4/1993 |

(Continued)

OTHER PUBLICATIONS

Kporean Intellectual Property Office Internatiaonl Search Report for PCT/US2010/050869, dated Feb. 24, 2011 Feb. 24, 2011.

(Continued)

*Primary Examiner* — Kyle Armstrong
(74) *Attorney, Agent, or Firm* — Michael J. Nickerson; Dawson Law Firm, PC

(57) ABSTRACT

A pile includes a shaft; and a soil displacement head or a helical blade with a leading edge and a trailing edge, operatively connected to a first end of the shaft; the shaft having deformations formed thereon to provide a gripping interface between a supporting medium and the shaft.

14 Claims, 23 Drawing Sheets

(56) References Cited

U.S. PATENT DOCUMENTS

| | | | |
|---|---|---|---|
| 5,575,593 | A | 11/1996 | Raaf |
| 5,707,180 | A | 1/1998 | Vickars et al. |
| 5,722,498 | A | 3/1998 | Van Impe et al. |
| 5,907,447 | A | 5/1999 | Sutton et al. |
| 5,919,005 | A | 7/1999 | Rupiper |
| 5,934,836 | A | 8/1999 | Rupiper et al. |
| 6,033,152 | A | 3/2000 | Blum |
| 6,264,402 | B1 | 7/2001 | Vickars et al. |
| 6,283,231 | B1 | 9/2001 | Coelus |
| 6,402,432 | B1 | 6/2002 | England et al. |
| 6,435,776 | B2 | 8/2002 | Vickars et al. |
| 6,503,024 | B2 | 1/2003 | Rupiper |
| 6,615,554 | B2 | 9/2003 | Rupiper |
| 6,652,195 | B2 | 11/2003 | Vickars et al. |
| 6,672,015 | B2 | 1/2004 | Cognon |
| 6,722,821 | B1 | 4/2004 | Perko et al. |
| 6,799,924 | B1 | 10/2004 | Kight et al. |
| 6,814,525 | B1 | 11/2004 | Whitsett |
| 6,902,352 | B2 | 6/2005 | Kim |
| 6,966,727 | B2 | 11/2005 | Kight et al. |
| 7,004,683 | B1 | 2/2006 | Rupiper |
| 7,198,434 | B2 | 4/2007 | Blum |
| 7,314,335 | B2 | 1/2008 | Whitsett |
| 7,338,232 | B2 | 3/2008 | Nasr |
| 8,033,757 | B2 | 10/2011 | Stroyer |
| 2001/0045067 | A1 | 11/2001 | Cognon |
| 2004/0105727 | A1 | 6/2004 | Jones |
| 2005/0031418 | A1 | 2/2005 | Whitsett |
| 2006/0013656 | A1 | 1/2006 | Blum |
| 2006/0260849 | A1 | 11/2006 | Pedrelli |
| 2007/0286685 | A1 | 12/2007 | Lindsey |
| 2007/0286686 | A1 | 12/2007 | Lindsey |
| 2008/0063479 | A1 | 3/2008 | Stroyer |

FOREIGN PATENT DOCUMENTS

| | | | | |
|---|---|---|---|---|
| KR | 20070038190 | A | * | 4/2007 |
| KR | 100841735 | | | 6/2008 |
| KR | 100894988 | | | 4/2009 |
| KR | 200462047 | Y1 | * | 8/2012 |
| KR | 20160002097 | A | * | 1/2016 |
| WO | WO2004020744 | | | 3/2009 |
| WO | WO2018076054 | | | 5/2018 |

OTHER PUBLICATIONS

Standard Specification for Deformed and Plain Carbon-Steel Bars for Concrete Reinforcement (A615/A615M-20) 2020 Jan. 1, 2020.

Internatiaonl Search Report for PCT/US2019/057208, dated Jan. 17, 2020 Jan. 17, 2020.

* cited by examiner

Table 1

| Bar Designation No. | Nominal Weight, lb/ft [Nominal Mass, kg/m] | Nominal Dimensions[A] | | | Deformation Requirements, in. [mm] | | |
|---|---|---|---|---|---|---|---|
| | | Diameter, in. [mm] | Cross-Sectional Area, in.$^2$ [mm$^2$] | Perimeter, in. [mm] | Maximum Average Spacing | Minimum Average Height | Maximum Gap (Chord of 12.5 % of Nominal Perimeter) |
| 3 [10] | 0.376 [0.560] | 0.375 [9.5] | 0.11 [71] | 1.178 [29.9] | 0.262 [6.7] | 0.015 [0.38] | 0.143 [3.6] |
| 4 [13] | 0.668 [0.994] | 0.500 [12.7] | 0.20 [129] | 1.571 [39.9] | 0.350 [8.9] | 0.020 [0.51] | 0.191 [4.9] |
| 5 [16] | 1.043 [1.552] | 0.625 [15.9] | 0.31 [199] | 1.963 [49.9] | 0.437 [11.1] | 0.028 [0.71] | 0.239 [6.1] |
| 6 [19] | 1.502 [2.235] | 0.750 [19.1] | 0.44 [284] | 2.356 [59.8] | 0.525 [13.3] | 0.038 [0.97] | 0.286 [7.3] |
| 7 [22] | 2.044 [3.042] | 0.875 [22.2] | 0.60 [387] | 2.749 [69.8] | 0.612 [15.5] | 0.044 [1.12] | 0.334 [8.5] |
| 8 [25] | 2.670 [3.973] | 1.000 [25.4] | 0.79 [510] | 3.142 [79.8] | 0.700 [17.8] | 0.050 [1.27] | 0.383 [9.7] |
| 9 [29] | 3.400 [5.060] | 1.128 [28.7] | 1.00 [645] | 3.544 [90.0] | 0.790 [20.1] | 0.056 [1.42] | 0.431 [10.9] |
| 10 [32] | 4.303 [6.404] | 1.270 [32.3] | 1.27 [819] | 3.990 [101.3] | 0.889 [22.6] | 0.064 [1.63] | 0.487 [12.4] |
| 11 [36] | 5.313 [7.907] | 1.410 [35.8] | 1.56 [1006] | 4.430 [112.5] | 0.987 [25.1] | 0.071 [1.80] | 0.540 [13.7] |
| 14 [43] | 7.65 [11.38] | 1.693 [43.0] | 2.25 [1452] | 5.32 [135.1] | 1.185 [30.1] | 0.085 [2.16] | 0.648 [16.5] |
| 18 [57] | 13.60 [20.24] | 2.257 [57.3] | 4.00 [2581] | 7.09 [180.1] | 1.58 [40.1] | 0.102 [2.59] | 0.864 [21.9] |
| 20 [64][B] | 16.69 [24.84] | 2.500 [63.5] | 4.91 [3167] | 7.85 [199.5] | 1.75 [44.5] | 0.113 [2.86] | 0.957 [24.3] |

[A] The nominal dimensions of a deformed bar are equivalent to those of a plain round bar having the same weight [mass] per foot [metre] as the deformed bar.
[B] Refer to Note 3.

Figure 21

Table 2

| Bar Designation No.[A] | Nominal Weight, lb/ft[B] [Nominal Mass, kg/m][C] | Nominal Dimensions[D] | | | Deformation Requirements, in. [mm] | | |
|---|---|---|---|---|---|---|---|
| | | Diameter, in. [mm] | Cross-Sectional Area in.$^2$ [mm$^2$] | Perimeter, in. [mm] | Maximum Average Spacing | Minimum Average Height | Maximum Gap (Chord of 12.5 % of Nominal Perimeter) |
| 10 | 0.414 [0.617] | 0.394 [10.0] | 0.12 [79] | 1.237 [31.4] | 0.276 [7.0] | 0.016 [0.40] | 0.151 [3.8] |
| 12 | 0.597 [0.888] | 0.472 [12.0] | 0.18 [113] | 1.484 [37.7] | 0.331 [8.4] | 0.019 [0.48] | 0.181 [4.6] |
| 16 | 1.061 [1.578] | 0.630 [16.0] | 0.31 [201] | 1.979 [50.3] | 0.441 [11.2] | 0.028 [0.72] | 0.241 [6.1] |
| 20 | 1.657 [2.466]† | 0.787 [20.0] | 0.49 [314] | 2.474 [62.8] | 0.551 [14.0] | 0.039 [1.00] | 0.301 [7.7] |
| 25 | 2.589 [3.853] | 0.984 [25.0] | 0.76 [491] | 3.092 [78.5] | 0.689 [17.5] | 0.049 [1.25] | 0.377 [9.6] |
| 28 | 3.248 [4.834] | 1.102 [28.0] | 0.95 [616] | 3.463 [88.0] | 0.772 [19.6] | 0.055 [1.40] | 0.422 [10.7] |
| 32 | 4.242 [6.313] | 1.260 [32.0] | 1.25 [804] | 3.958 [100.5] | 0.882 [22.4] | 0.063 [1.60] | 0.482 [12.2] |
| 36 | 5.369 [7.990] | 1.417 [36.0] | 1.58 [1018] | 4.453 [113.1] | 0.992 [25.2] | 0.071 [1.80] | 0.542 [13.8] |
| 40 | 6.629 [9.865] | 1.575 [40.0] | 1.95 [1257] | 4.947 [125.7] | 1.102 [28.0] | 0.79 [2.00] | 0.603 [15.3] |
| 50 | 10.36 [15.41] | 1.969 [50.0] | 3.04 [1963] | 6.184 [157.1] | 1.378 [35.0] | 0.098 [2.50] | 0.753 [19.1] |
| 60 | 14.91 [22.20] | 2.362 [60.0] | 4.38 [2827] | 7.421 [188.5] | 1.654 [42.0] | 0.106 [2.70] | 0.904 [23.0] |

† Editorially corrected.

[A] The bar designations are based on the number of millimetres of the nominal diameter of the bar.

[B] The assumed weight of a cubic foot of steel is 490 lb/ft$^3$ in accordance with Specification A6/A6M.

[C] The assumed mass of a cubic metre of steel is 7850 kg/m$^3$ in accordance with Specification A6/A6M

[D] The nominal dimensions of a deformed bar are equivalent to those of a plain round bar having the same weight [mass] per foot [metre] as the deformed bar.

Figure 22

DEFORMED PILE SHAFT FOR PROVIDING GRIPPING CONTACT WITH A SUPPORTING MEDIUM AND RESISTING THE SUPPORTING MEDIUM FROM SHEARING

PRIORITY INFORMATION

The present application is a continuation-in-part of U.S. patent application Ser. No. 16/658,830, filed on Oct. 21, 2019; said U.S. patent application Ser. No. 16/658,830, filed on Oct. 21, 2019, claims priority, under 35 U.S.C. § 119(e), from U.S. Provisional Patent Application No. 62/748,493, filed on Oct. 21, 2018. The present application claims priority, under 35 U.S.C. § 119(e), from U.S. Provisional Patent Application No. 62/748,493, filed on Oct. 21, 2018.

The entire contents of Ser. No. 16/658,830, filed on Oct. 21, 2019, and U.S. Provisional Patent Application No. 62/748,493, filed on Oct. 21, 2018, are hereby incorporated by reference.

BACKGROUND

Conventional piles are metal tubes having either a circular or a rectangular cross-section. Such piles are mounted in the ground to provide a support structure for the construction of superstructures. The piles are provided in sections that are driven into the ground.

An example of a conventional pile is illustrated in FIG. 1. More specifically, FIG. 1 is a schematic view of one embodiment of an auger grouted pile.

As illustrated in FIG. 1, an auger grouted pile 100 includes an elongated, tubular pipe 102 with a hollow central chamber, a top section 104 and a bottom section 106. Bottom section 106 includes a soil (medium) displacement head 108. Top section 104 includes a reverse auger 110. Soil (medium) displacement head 108 has a helical blade 112 that has a leading edge 114 and a trailing edge 116.

The leading edge 114 of helical blade 112 cuts into the soil (medium) as the pile is rotated into the soil (medium) at such contact point. The soil (medium) displacement head 108 may be equipped with a point 118 to promote this cutting.

The soil (medium) passes over helical blade 112 and thereafter past trailing edge 116. The uppermost portion of helical blade 112 includes a deformation structure 120 that displaces the soil (medium) to create irregularities in an annulus formed by a lateral compaction element 119.

It is noted that some conventional piles have a cutting tip that permits them to be rapidly deployed. By rotating the pile, the helical blade pulls the pile into the ground (medium), thus greatly reducing the amount of downward force necessary to bury the pile. Unfortunately, the rotary action of the pile also loosens the soil which holds the pile in place. This reduces the amount of vertical support the pile provides.

Sometimes, grout or other supporting medium is introduced around the pile in an attempt to solidify the volume around the pile and thus compensate for the loose soil. In addition, to providing grout to the area around the pile, the grout, to be effective, needs to be able to grip or have a frictional contact with the pile to prevent any slippage between the grout and the pile, thereby strengthening the vertical support the pile provides.

U.S. Pat. No. 6,817,810 discloses a helical pile that includes a shaft with rounded notches laid out in a precise non-random pattern to facilitate a helical plate to be screwed onto the shaft.

The rounded notches are only on the extreme corners of the square shaft and thereby the rounded notches do not provide a substantial resistance to shear in the supporting medium or grout that may be added to the bore hole. Moreover, the rounded nature of the notches on the shaft does not provide gripping or frictional contact with the grout to prevent slippage between the grout and the pile.

Additionally, the very small area of the notches on the shaft does not provide gripping or frictional contact with the supporting medium or grout to prevent any slippage between the supporting medium or grout and the pile.

Therefore, it is desirable to provide a pile that is configured or shaped to provide gripping or frictional contact with the supporting medium or grout to prevent any slippage between the supporting medium or grout and the pile, thereby strengthening the vertical support the pile provides.

Also, it is desirable to provide a pile that is configured or shaped to resist the supporting medium or grout from shearing along its surface.

BRIEF DESCRIPTION OF THE DRAWINGS

The drawings are only for purposes of illustrating various embodiments and are not to be construed as limiting, wherein:

FIG. 21 is a table showing ASTM Standards' requirements for deformations;

FIG. 22 is another table showing ASTM Standards' requirements for deformations;

DETAILED DESCRIPTION

Figure 1:
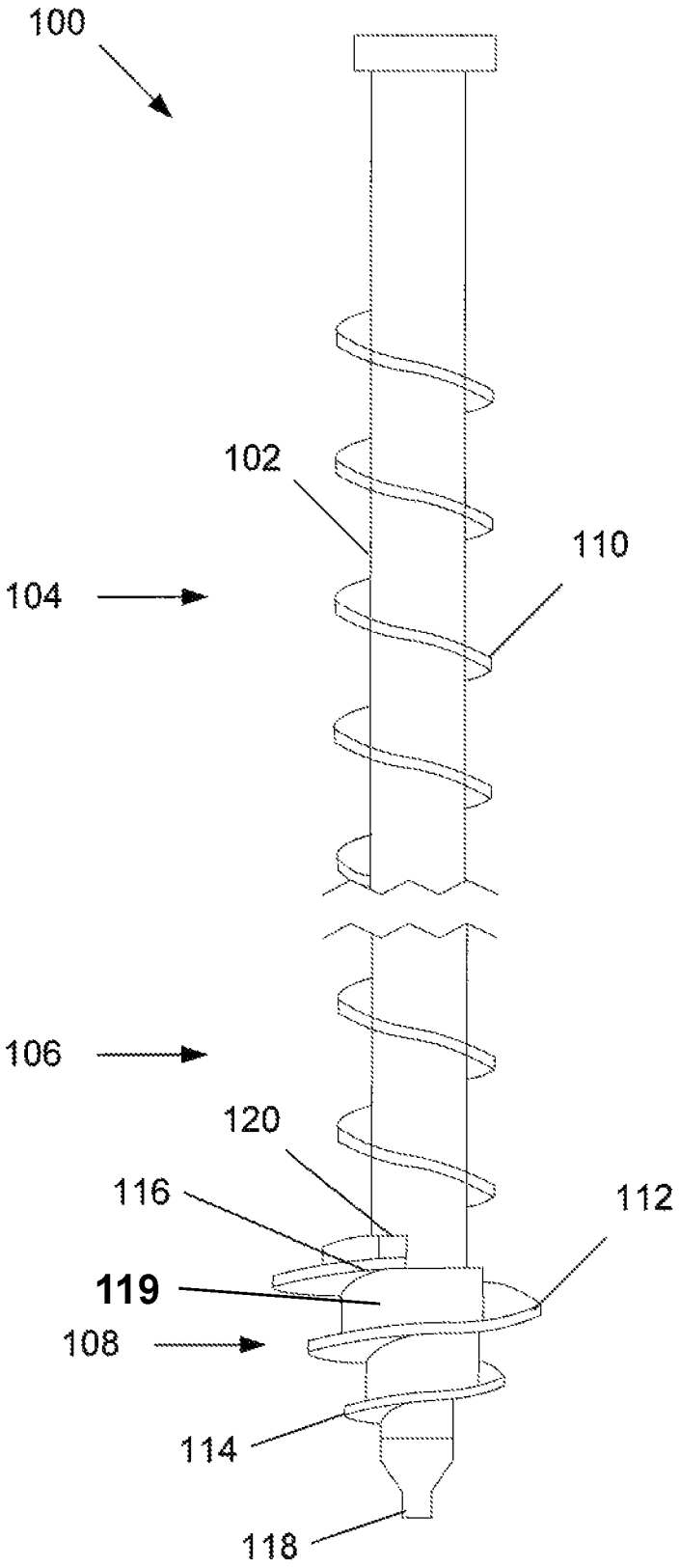
FIG. 1 illustrates a conventional pile.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts may be properly illustrated.

Figure 2:
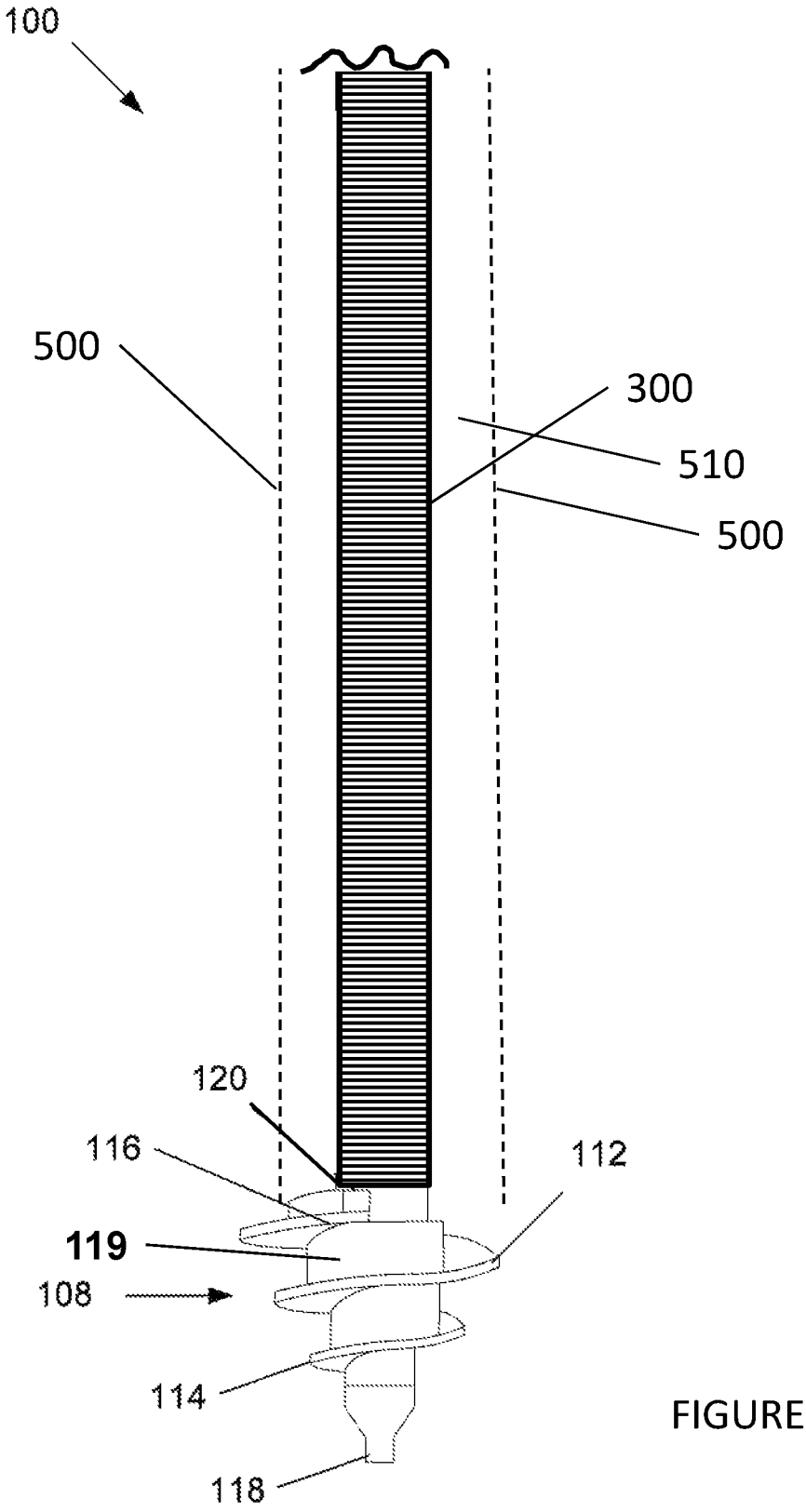
FIG. 2 illustrates an example of a pile for providing gripping contact with a supporting medium or grout and resisting the supporting medium or grout from shearing.

An example of a pile for providing gripping contact with a supporting medium or grout and resisting the supporting medium or grout from shearing is illustrated in FIG. 2. More specifically, FIG. 2 is a schematic view of one embodiment of a pile.

As illustrated in FIG. 2, a pile 100 includes a threaded shaft 300. A bottom section of the pile 100 includes a soil (medium) displacement head 108. Soil (medium) displacement head 108 has a helical blade 112 that has a leading edge 114 and a trailing edge 116.

It is noted that the threaded shaft 300 may be realized by including a single continuous raised helical thread (rib) on the outer surface of the shaft or a single continuous helical channel on the outer surface of the shaft. It is further noted that the threaded shaft 300 may be realized by including a plurality of non-helical parallel deformations, each non-helical parallel deformations encircling the entire outer surface of the shaft. It is additionally noted that the threaded shaft 300 may be realized by including a plurality of non-helical parallel raised rings, each raised ring encircling the entire outer surface of the shaft. It is also noted that the threaded shaft 300 may be realized by including a plurality of non-helical parallel ringed channels, each ringed channel encircling the entire outer surface of the shaft.

A non-helical parallel deformation, a non-helical parallel raised ring, and/or a non-helical parallel ringed channel, as used in describing the threaded shaft 300, form a plane, wherein the plane, formed by the non-helical parallel deformation, non-helical parallel raised ring, and/or non-helical parallel ringed channel, is orthogonal, in two dimensions, to a central axis of the threaded shaft 300. On the other hand, a helical deformation (continuous raised helical thread or continuous helical channel), as used in describing the threaded shaft 300, forms a plane, wherein the plane, formed by the helical deformation (continuous raised helical thread or continuous helical channel), is not orthogonal, in two dimension, to a central axis of the threaded shaft 300.

The threaded shaft 300 creates a deformed bar, which has gap measurements that are in accordance with ATSM Standard A615/A615M-20. The entire content of the ATSM Standard A615/A615M-20 is hereby incorporated by reference.

Moreover, the deformed bar, created by the threaded shaft 300, may meet some or all of the following ATSM Standards shown in Table 1 (FIG. 21) and/or Table 2 (FIG. 22): the maximum average spacing between the threads of the threaded shaft 300, and/or the minimum average height of the threads on the threaded shaft 300.

For example, if the physical characteristics of threaded shaft 300 classify the threaded shaft 300 as Bar Designation Number 10 in Table 2 (FIG. 22), the maximum average spacing between the threads of the threaded shaft 300 may be 0.276 inches, the minimum average height of the threads on the threaded shaft 300 may be 0.016 inches, and/or the maximum gap may be 0.151 inches.

According to the ATSM Standard A615/A615M-20, the deformations shall be spaced along the bar at substantially uniform distances. The deformations on opposite sides of the bar shall be similar in size, shape, and pattern.

Moreover, according to the ATSM Standard A615/A615M-20, the deformations shall be placed with respect to the axis of the bar so that the included angle is not less than 45°. Where the line of deformations forms an included angle with the axis of the bar from 45 to 70° inclusive, the deformations shall alternately reverse in direction on each side, or those on one side shall be reversed in direction from those on the opposite side. Where the line of deformations is over 70°, a reversal in direction shall not be required.

Furthermore, according to the ATSM Standard A615/A615M-20, the average spacing or distance between deformations on each side of the bar shall not exceed seven tenths of the nominal diameter of the bar.

Additionally, according to the ATSM Standard A615/A615M-20, the overall length of deformations shall be such that the gap (measured as a chord) between the ends of the deformations shall not exceed 12.5% of the nominal perimeter of the bar. Where the ends terminate in a rib, the width of the rib shall be considered as the gap between these ends. The summation of the gaps shall not exceed 25% of the nominal perimeter of the bar. The nominal perimeter of the bar shall be 3.1416 times the nominal diameter.

The spacing, height, and gap of deformations shall conform to the requirements shown in Table 1 (FIG. 21) and Table 2 (FIG. 22).

The average spacing of deformations may be determined by measuring the length of a minimum of ten spaces and dividing that length by the number of spaces included in the measurement. The measurement may begin from a point on a deformation at the beginning of the first space to a corresponding point on a deformation after the last included space.

The average height of deformations may be determined from measurements made on not less than two typical deformations. Determinations may be based on three measurements per deformation, one at the center of the overall length and the other two at the quarter points of the overall length.

The leading edge 114 of helical blade 112 cuts into the soil (medium) as the pile 100 is rotated. The soil (medium) displacement head 108 may be equipped with a point 118 to promote this cutting.

The soil (medium) passes over helical blade 112 and thereafter past trailing edge 116. As the soil (medium) passes over helical blade 112, the soil (medium) is laterally compacted by lateral compaction elements 119 (lateral compaction elements 200 are discussed in more detail below with respect to FIGS. 6, 8, 10, and 12). The lateral compaction elements 119 create an annulus having outer wall 500 and void 510.

The uppermost portion of helical blade 112 may include a deformation structure 120 (located near the trailing edge 116) that displaces the soil (medium) to create a spiral groove in the outer wall 500 of the annulus.

After the pile 100 is driven into position, supporting medium or grout (not shown) may be introduced into the void 510 of the annulus. The supporting medium or grout can be introduced by means of gravity or pressure into the void 510 of the annulus.

Additionally, since the pile 100 may be a hollow tube, the supporting medium or grout can be introduced into the void 510 of the annulus through the hollow tube by means of gravity or pressure, wherein the pile 100 would include openings (not shown) that allows the supporting medium or grout to leave the pile and enter into the void 510 of the annulus.

The introduced supporting medium or grout surrounds the threaded shaft 300 of the pile 100. The threaded surface of the threaded shaft 300 of the pile 100 provides a gripping interface between the supporting medium or grout and the pile 100, as well as, provides an interface that resists the supporting medium or grout from shearing along the surface between the supporting medium or grout and the pile 100.

Figure 3:
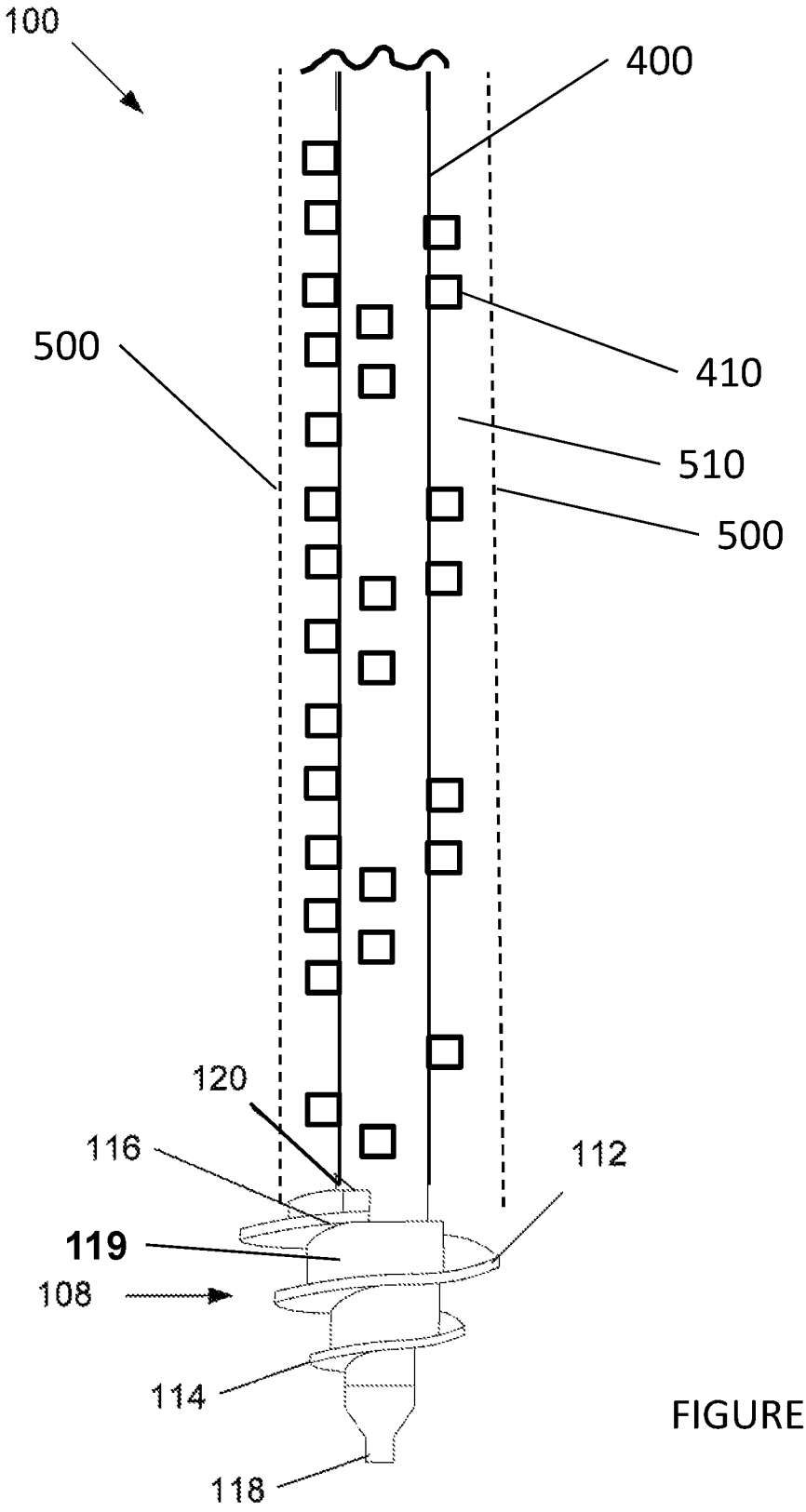
FIG. 3 illustrates another example of a pile for providing gripping contact with a supporting medium or grout and resisting the supporting medium or grout from shearing.

Another example of a pile for providing gripping contact with the supporting medium or grout and resisting the supporting medium or grout from shearing is illustrated in FIG. 3. More specifically, FIG. 3 is a schematic view of one embodiment of a pile.

As illustrated in FIG. 3, a pile 100 includes a shaft 400 having projections 410 on the outer surface. The projections (protrusions) 410 may be randomly placed on the outer surface of the shaft 400 or be placed in a pattern. The projections (protrusions) 410 extend out from the outer surface of the shaft 400 into the void 510 of an annulus without coming into contact with an outer wall 500 of the annulus.

Preferably, the projections (protrusions) 410 increase the area of the skin resistance with the supporting medium or grout to resist the grout from shearing along the surface between the supporting medium or grout and the shaft 400.

The projections (protrusions) 410 create a deformed bar in accordance with ATSM Standard A615/A615M-20. More specifically, the deformed bar, created by the threaded shaft 300, may meet some or all of the following ATSM Standards shown in Table 1 (FIG. 21) and/or Table 2 (FIG. 22): the maximum average spacing between the projections (protrusions) 410, the minimum average height of the projections (protrusions) 410, and the maximum gap of the projections (protrusions) 410.

For example, if the physical characteristics of the pile 100 classify the pile 100 as Bar Designation Number 10 in Table 2 (FIG. 22), the maximum average spacing between the projections (protrusions) 400 may be 0.276 inches, the minimum average height of the projections (protrusions) 400 may be 0.016 inches, and/or the maximum gap of the projections (protrusions) 400 may be 0.151 inches.

A bottom section of the pile 100 includes a soil (medium) displacement head 108. Soil (medium) displacement head 108 has a helical blade 112 that has a leading edge 114 and a trailing edge 116.

The leading edge 114 of helical blade 112 cuts into the soil (medium) as the pile 100 is rotated. The soil (medium) displacement head 108 may be equipped with a point 118 to promote this cutting.

The soil (medium) passes over helical blade 112 and thereafter past trailing edge 116. As the soil (medium) passes over helical blade 112, the soil (medium) is laterally compacted by lateral compaction elements 119 (discussed in more detail below). The lateral compaction elements 119 create an annulus having outer wall 500 and void 510.

The uppermost portion of helical blade 112 may include a deformation structure 120 that displaces the soil (medium) to create a spiral groove in the outer wall 500 of the annulus.

After the pile 100 is driven into position, supporting medium or grout (not shown) may be introduced into the void 510 of the annulus. The supporting medium or grout can be introduced by means of gravity or pressure into the void 510 of the annulus.

Additionally, since the pile 100 may be a hollow tube, the supporting medium or grout can be introduced into the void 510 of the annulus through the hollow tube by means of gravity or pressure, wherein the pile 100 would include openings (not shown) that allows the supporting medium or grout to leave the pile and enter into the void 510 of the annulus.

The introduced supporting medium or grout surrounds the projections (protrusions) 410 of the shaft 400. The projections (protrusions) 410 of the shaft 400 provide gripping interface between the supporting medium or grout and the shaft 400, as well as, provide an interface that resists the supporting medium or grout from shearing along the surface between the supporting medium or grout and the shaft 400.

Figure 4:
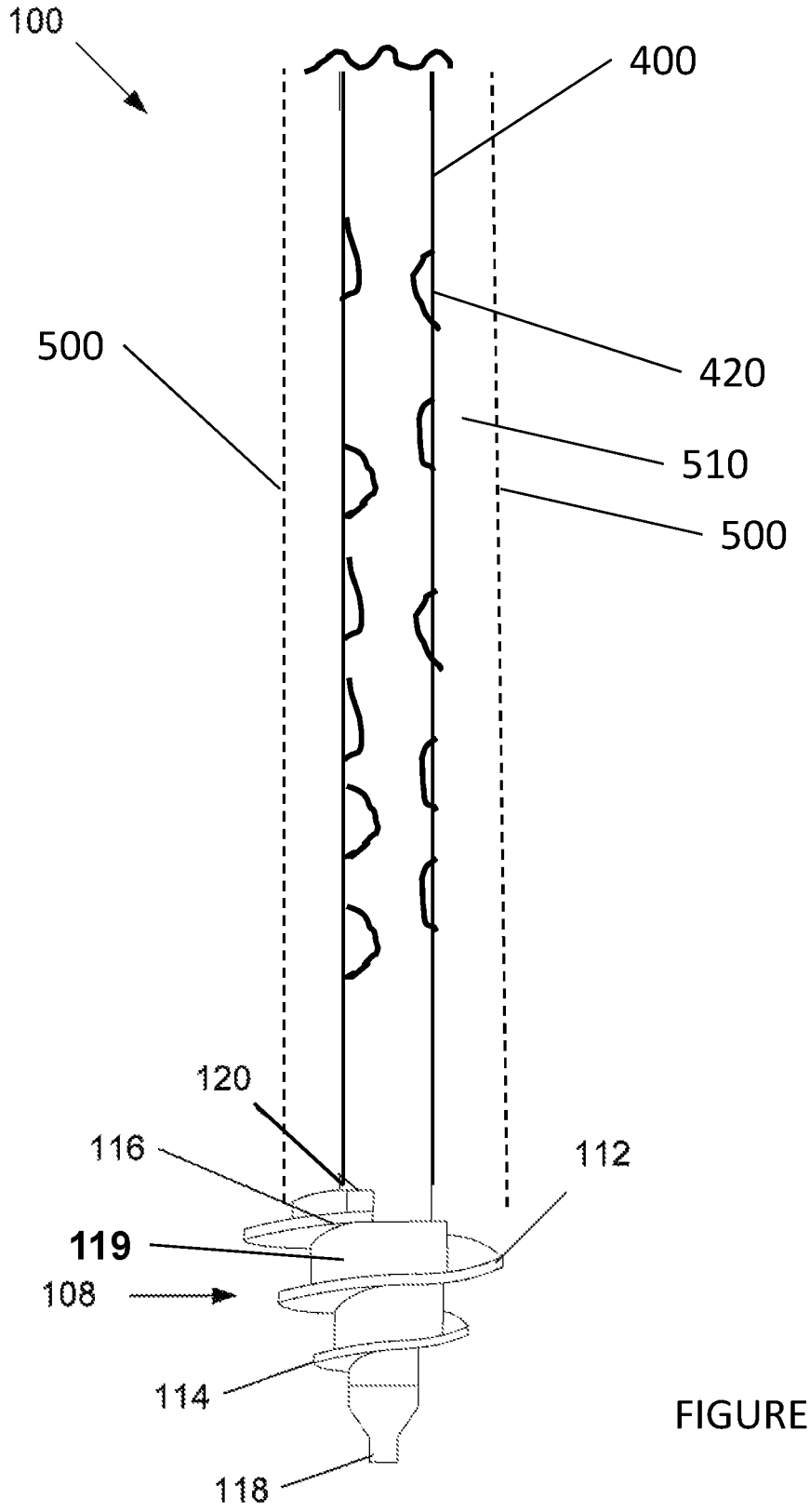
FIG. 4 illustrates a third example of a pile for providing gripping contact with a supporting medium or grout and resisting the supporting medium or grout from shearing.

A third example of a pile for providing gripping contact with the supporting medium or grout and resisting the supporting medium or grout from shearing is illustrated in FIG. 4. More specifically, FIG. 4 is a schematic view of one embodiment of a pile.

As illustrated in FIG. 4, a pile 100 includes a shaft 400 having indentations 420 on the outer surface. The indentations 420 may be randomly placed on the outer surface of the shaft 400 or be placed in a pattern. The indentations 420 extend inwardly from the outer surface of the shaft 400 away from the void 510 of an annulus. The indentations 420 do not extend into the center of the shaft 400; thus, the indentations 420 do not create a hole or opening between a hollow interior of the shaft 400 and an exterior surface of the shaft 400. More specifically, the indentations 420 have a solid bottom surface and solid side surfaces such that the indentations 420 are formed in the surface of the shaft 400, not through the shaft 400.

Preferably, the indentations 420 increase the area of the skin resistance with the supporting medium or grout to resist the supporting medium or grout from shearing along the surface between the supporting medium or grout and the shaft 400.

The indentations 420 create a deformed bar in accordance with ATSM Standard A615/A615M-20. More specifically, the deformed bar, created by the threaded shaft 300, may meet some or all of the following ATSM Standards shown in Table 1 (FIG. 21) and/or Table 2 (FIG. 22): the maximum average spacing between the indentations 420, the minimum average height of the indentations 420, and the maximum gap of the indentations 420.

For example, if the physical characteristics of the pile 100 classify the pile 100 as Bar Designation Number 10 in Table 2 (FIG. 22), the maximum average spacing between the indentations 420 may be 0.276 inches, the minimum average depth of the indentations 420 may be 0.016 inches, and/or the maximum gap of the indentations 420 may be 0.151 inches.

A bottom section of the pile 100 includes a soil (medium) displacement head 108. Soil (medium) displacement head 108 has a helical blade 112 that has a leading edge 114 and a trailing edge 116.

The leading edge 114 of helical blade 112 cuts into the soil (medium) as the pile 100 is rotated. The soil (medium) displacement head 108 may be equipped with a point 118 to promote this cutting.

The soil (medium) passes over helical blade 112 and thereafter past trailing edge 116. As the soil (medium) passes over helical blade 112, the soil (medium) is laterally compacted by lateral compaction elements 119 (discussed in more detail below). The lateral compaction elements 119 create an annulus having outer wall 500 and void 510.

The uppermost portion of helical blade 112 may include a deformation structure 120 that displaces the soil (medium) to create a spiral groove in the outer wall 500 of the annulus.

After the pile 100 is driven into position, supporting medium or grout (not shown) may be introduced into the void 510 of the annulus. The supporting medium or grout can be introduced by means of gravity or pressure into the void 510 of the annulus.

Additionally, since the pile 100 may be a hollow tube, the supporting medium or grout can be introduced into the void 510 of the annulus through the hollow tube by means of gravity or pressure, wherein the pile 100 would include openings (not shown) that allows the supporting medium or grout to leave the pile and enter into the void 510 of the annulus.

The introduced supporting medium or grout surrounds the indentations 420 of the shaft 400. The indentations 420 of the shaft 400 provide gripping interface between the supporting medium or grout and the shaft 400, as well as, provide an interface that resists the supporting medium or grout from shearing along the surface between the supporting medium or grout and the shaft 400.

Figure 5:
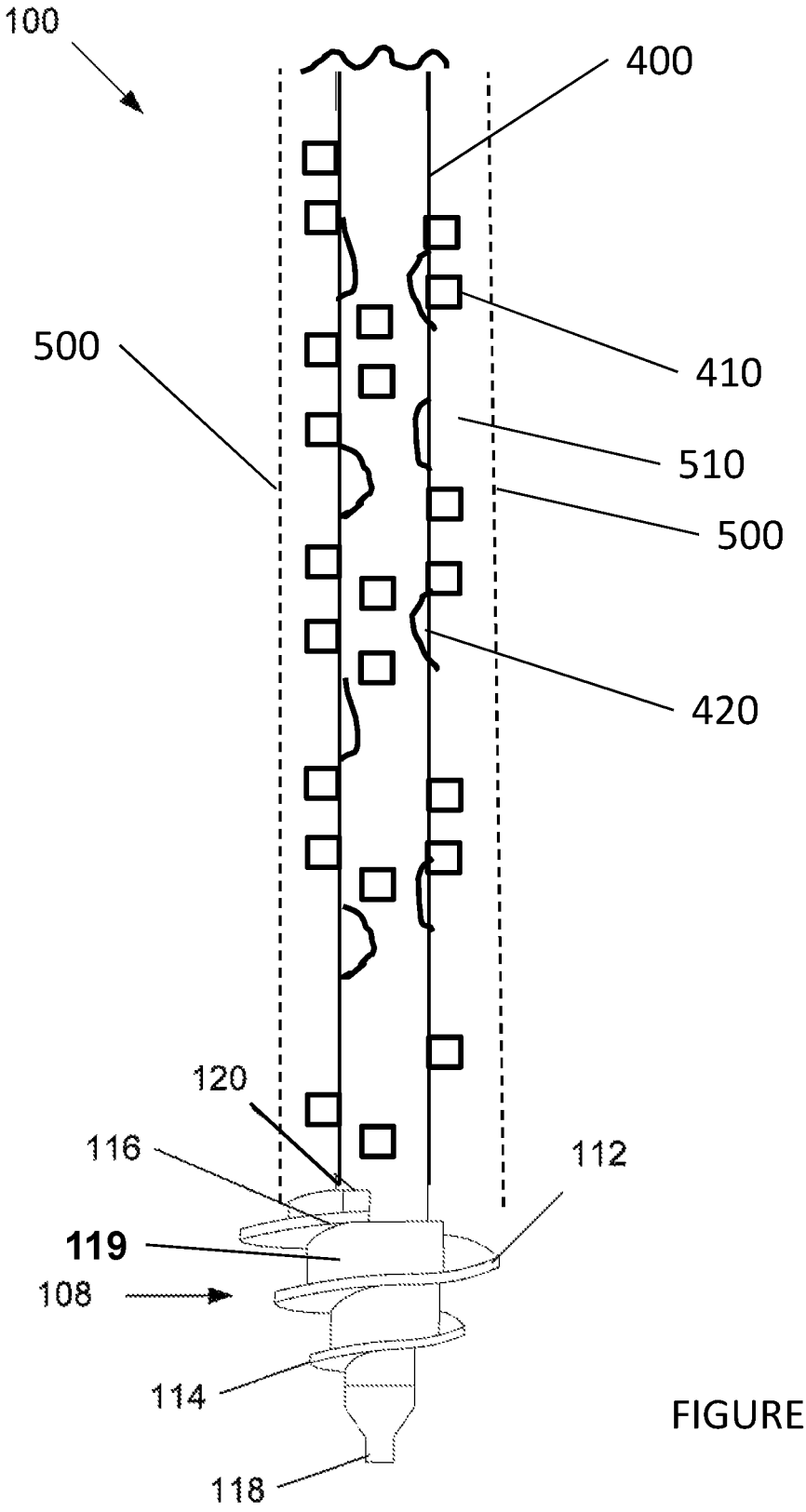
FIG. 5 illustrates a fourth example of a pile for providing gripping contact with a supporting medium or grout and resisting the supporting medium or grout from shearing.

A fourth example of a pile for providing gripping contact with the supporting medium or grout and resisting the supporting medium or grout from shearing is illustrated in FIG. 5. More specifically, FIG. 5 is a schematic view of one embodiment of a pile.

As illustrated in FIG. 5, a pile 100 includes a shaft 400 having indentations 420 and projections (protrusions) 410 on the outer surface. The indentations 420 and projections (protrusions) 410 may be randomly placed on the outer surface of the shaft 400 or be placed in a pattern. The indentations 420 extend inwardly from the outer surface of the shaft 400 away from the void 510 of an annulus, and the projections (protrusions) 410 extend out from the outer surface of the shaft 400 into the void 510 of an annulus without coming into contact with an outer wall 500 of the annulus.

Preferably, the projections (protrusions) 410 and the indentations 420 increase the area of the skin resistance with the supporting medium or grout to resist the supporting medium or grout from shearing along the surface between the supporting medium or grout and the shaft 400.

A bottom section of the pile 100 includes a soil (medium) displacement head 108. Soil (medium) displacement head 108 has a helical blade 112 that has a leading edge 114 and a trailing edge 116.

The leading edge 114 of helical blade 112 cuts into the soil (medium) as the pile 100 is rotated. The soil (medium) displacement head 108 may be equipped with a point 118 to promote this cutting.

The soil (medium) passes over helical blade 112 and thereafter past trailing edge 116. As the soil (medium) passes over helical blade 112, the soil (medium) is laterally compacted by lateral compaction elements (discussed in more detail below). The lateral compaction elements create an annulus having outer wall 500 and void 510.

The uppermost portion of helical blade 112 may include a deformation structure 120 that displaces the soil (medium) to create a spiral groove in the outer wall 500 of the annulus.

After the pile 100 is driven into position, supporting medium or grout (not shown) may be introduced into the void 510 of the annulus. The supporting medium or grout can be introduced by means of gravity or pressure into the void 510 of the annulus.

Additionally, since the pile 100 may be a hollow tube, the supporting medium or grout can be introduced into the void 510 of the annulus through the hollow tube by means of gravity or pressure, wherein the pile 100 would include openings (not shown) that allows the supporting medium or grout to leave the pile and enter into the void 510 of the annulus.

The introduced supporting medium or grout surrounds the indentations 420 and projections (protrusions) 410 of the shaft 400. The indentations 420 and projections (protrusions) 410 of the shaft 400 provide gripping interface between the supporting medium or grout and the shaft 400, as well as, provide an interface that resists the supporting medium or grout from shearing along the surface between the supporting medium or grout and the shaft 400.

Figure 6:
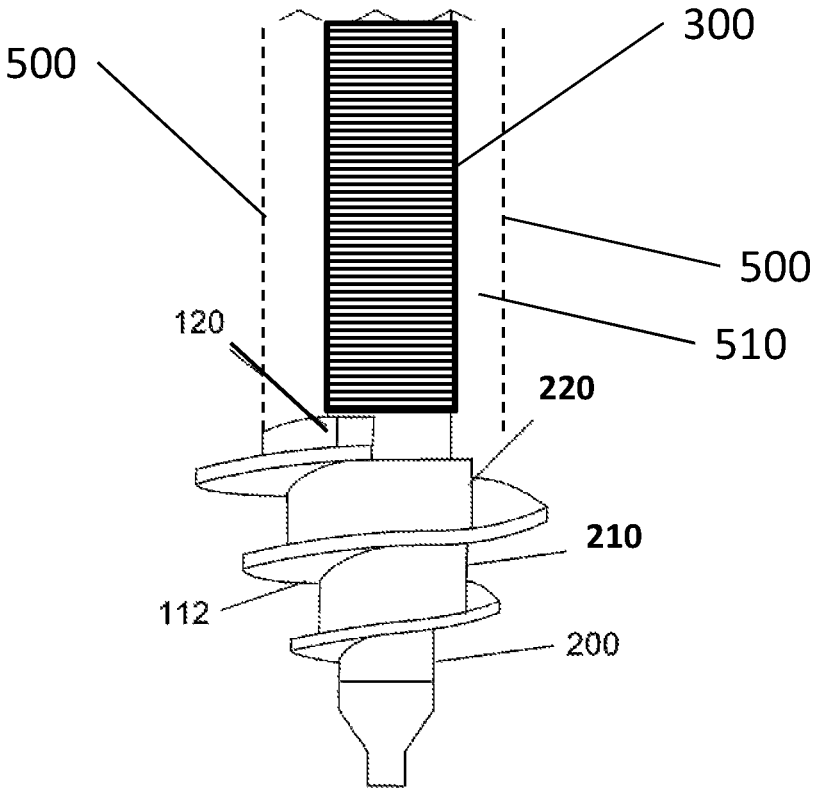
FIGS. 6 and 7 illustrate a bottom section of the pile of FIG. 2.
Figure 7:
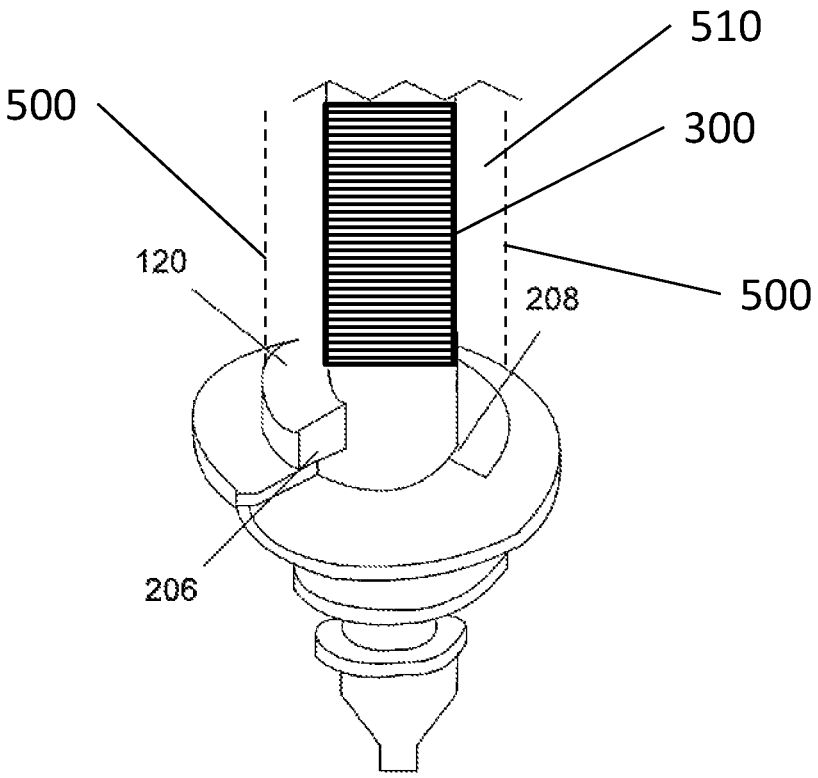

FIGS. 6 and 7 are side and perspective views of the bottom section of the pile of FIG. 2. The bottom section includes at least one lateral compaction element. In the embodiment shown in FIGS. 6 and 7, there are three such lateral compaction elements. The lateral compaction element 200 near the end of the pile has a diameter less than the diameter from the lateral compaction element 220 near deformation structure 120. The lateral compaction element 210 in the middle has a diameter that is between the diameters of the other two lateral compaction elements.

In this fashion, the soil is laterally compacted by the first lateral compaction element 200, more compacted by the second lateral compaction element 210 (enlarging the diameter of the bored hole) and even more compacted by the third lateral compaction element 220.

The helical blade 112 primarily cuts into the soil and only performs minimal soil compaction. The deformation structure 120 is disposed above the lateral compaction elements (200, 210, and 220). After the widest compaction element 220 has established an annulus with a regular diameter, deformation structure 120 cuts into the edge of the outer wall 500 of the annulus to leave a spiral pattern in the annulus's perimeter or circumference.

It is noted that, as illustrated in FIG. 7, the deformation structure 120 has a height that changes over the length of the deformation structure 120 from its greatest height at end 206 to a lesser height at end 208 as the deformation structure 120 coils about the pile in a helical configuration.

Figure 8:
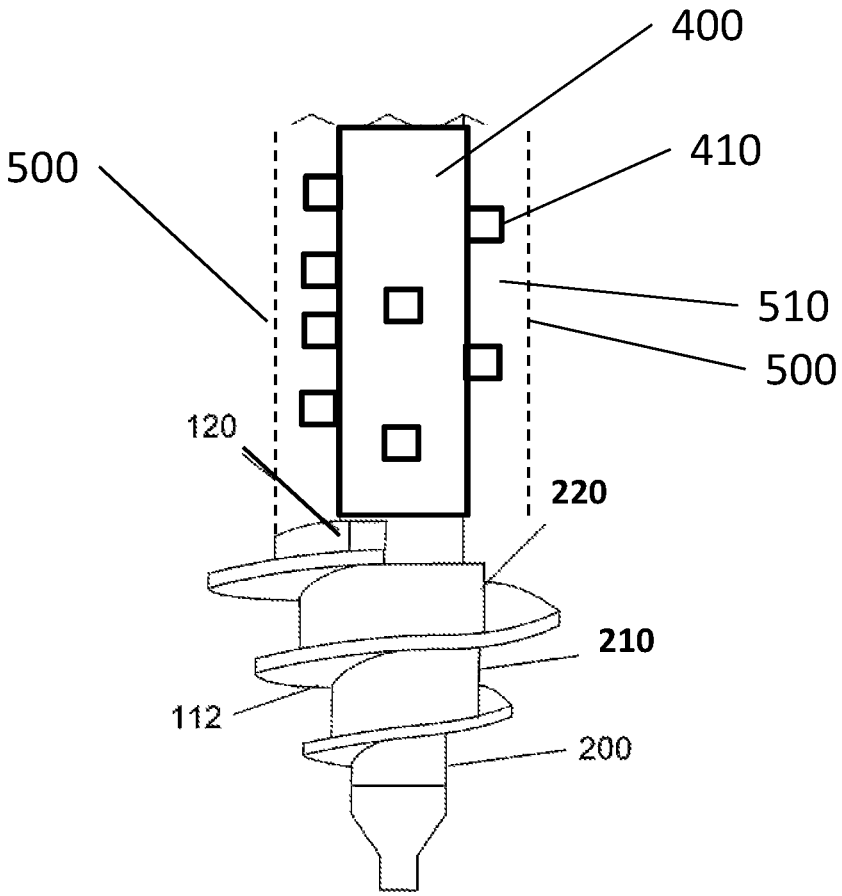
FIGS. 8 and 9 illustrate a bottom section of the pile of FIG. 3.
Figure 9:
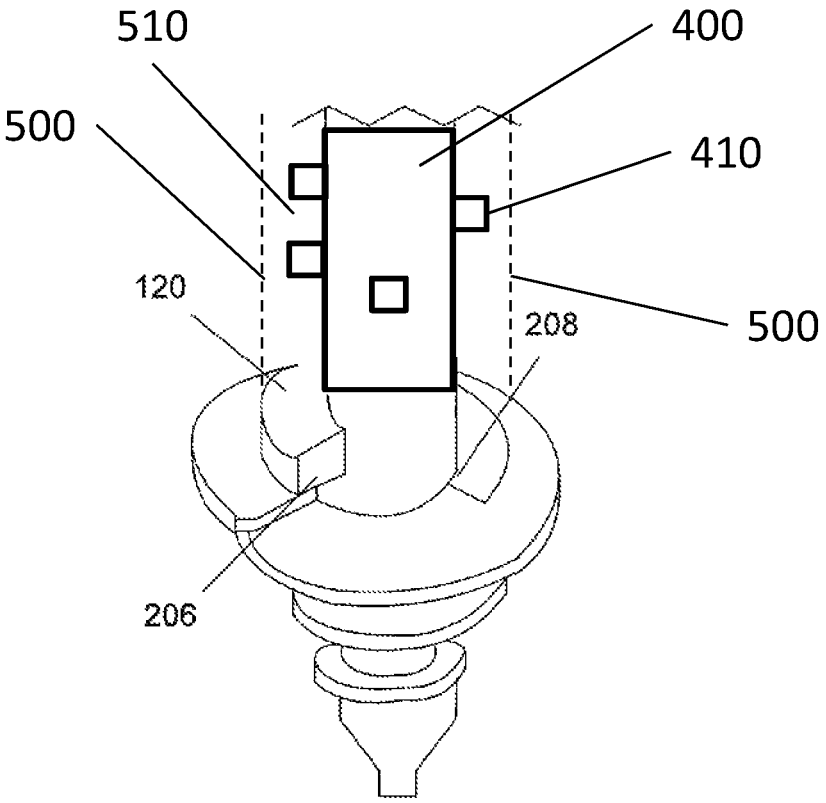

FIGS. 8 and 9 are side and perspective views of the bottom section of the pile of FIG. 3. The bottom section includes at least one lateral compaction element. In the embodiment shown in FIGS. 8 and 9, there are three such lateral compaction elements. The lateral compaction element 200 near the end of the pile has a diameter less than the diameter from the lateral compaction element 220 near deformation structure 120. The lateral compaction element 210 in the middle has a diameter that is between the diameters of the other two lateral compaction elements.

In this fashion, the soil is laterally compacted by the first lateral compaction element 200, more compacted by the second lateral compaction element 210 (enlarging the diameter of the bored hole) and even more compacted by the third lateral compaction element 220.

The helical blade 112 primarily cuts into the soil and only performs minimal soil compaction. The deformation structure 120 is disposed above the lateral compaction elements (200, 210, and 220). After the widest compaction element 200 has established an annulus with a regular diameter, deformation structure 120 cuts into the edge of the outer wall 500 of the annulus to leave a spiral pattern in the annulus's perimeter or circumference.

It is noted that, as illustrated in FIG. 9, the deformation structure 120 has a height that changes over the length of the deformation structure 120 from its greatest height at end 206 to a lesser height at end 208 as the deformation structure 120 coils about the pile in a helical configuration.

Figure 10:
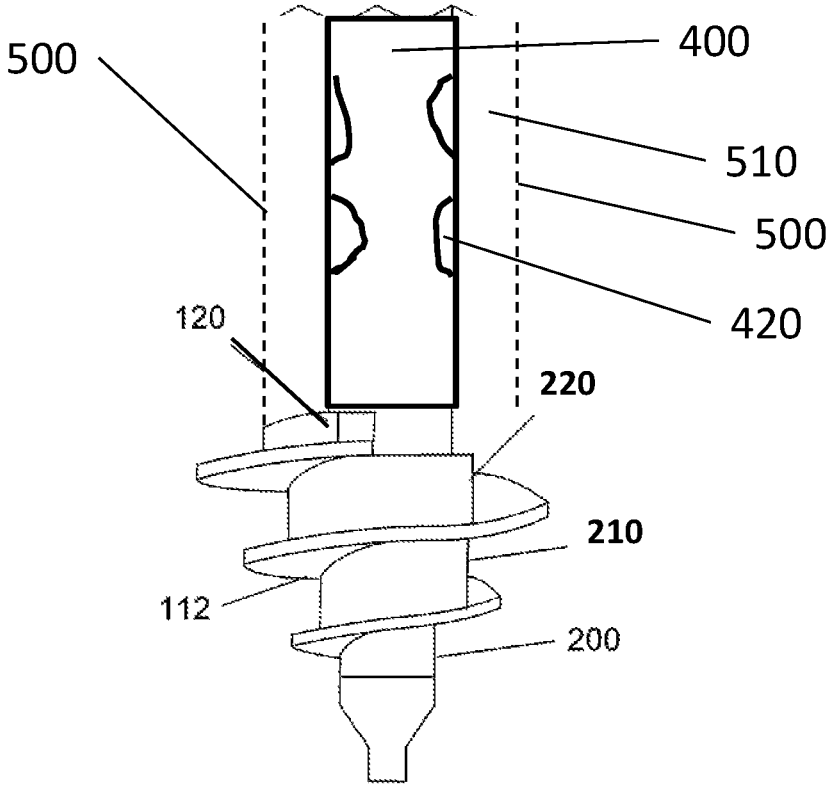
FIGS. 10 and 11 illustrate a bottom section of the pile of FIG. 4.
Figure 11:
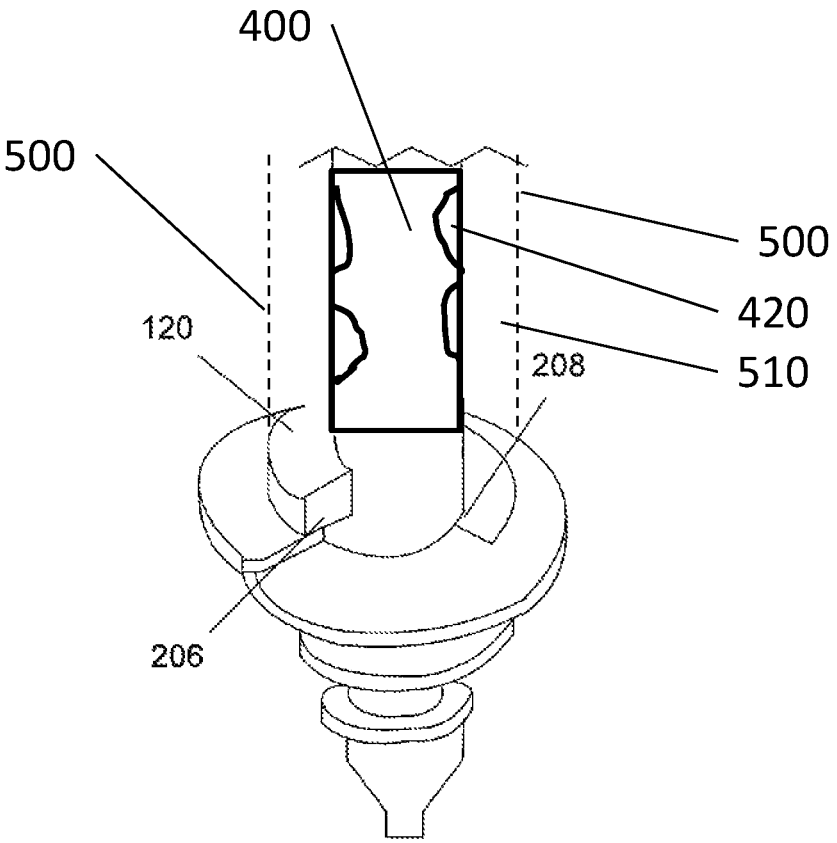

FIGS. 10 and 11 are side and perspective views of the bottom section of the pile of FIG. 4. The bottom section includes at least one lateral compaction element. In the embodiment shown in FIGS. 10 and 11, there are three such lateral compaction elements.

The lateral compaction element 200 near the end of the pile has a diameter less than the diameter from the lateral compaction element 220 near deformation structure 120. The lateral compaction element 210 in the middle has a diameter that is between the diameters of the other two lateral compaction elements.

In this fashion, the soil is laterally compacted by the first lateral compaction element 200, more compacted by the second lateral compaction element 210 (enlarging the diameter of the bored hole) and even more compacted by the third lateral compaction element 220.

The helical blade 112 primarily cuts into the soil and only performs minimal soil compaction. The deformation structure 120 is disposed above the lateral compaction elements (200, 210, and 220). After the widest compaction element 200 has established an annulus with a regular diameter, deformation structure 120 cuts into the edge of the outer wall 500 of the annulus to leave a spiral pattern in the annulus's perimeter or circumference.

It is noted that, as illustrated in FIG. 11, the deformation structure 120 has a height that changes over the length of the deformation structure 120 from its greatest height at end 206 to a lesser height at end 208 as the deformation structure 120 coils about the pile in a helical configuration.

Figure 12:
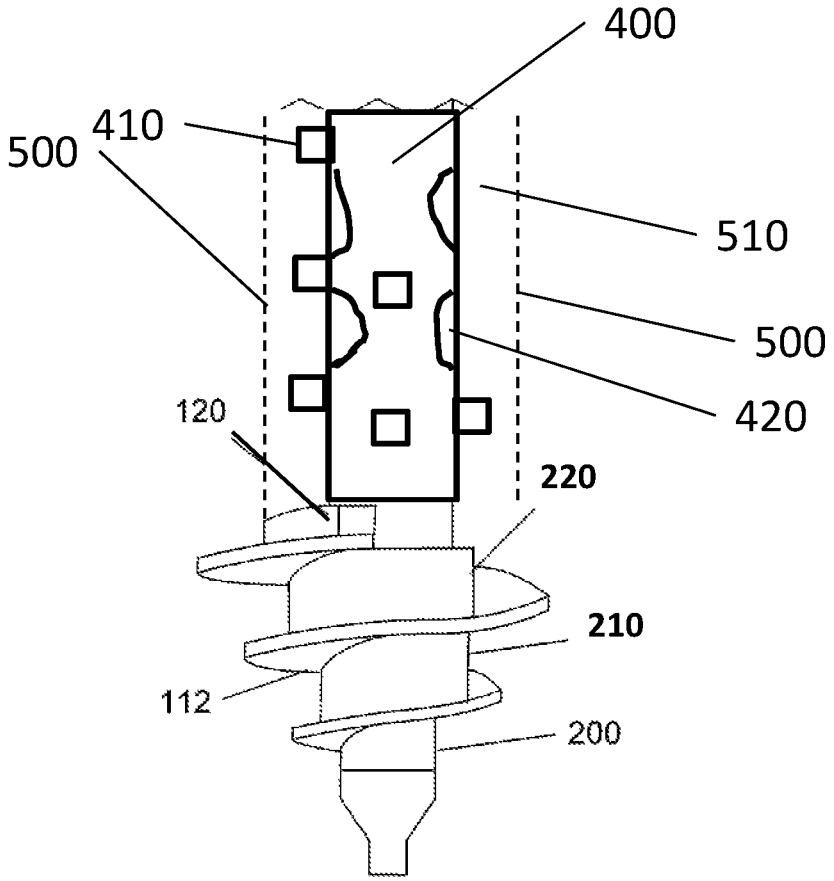
FIGS. 12 and 13 illustrate a bottom section of the pile of FIG. 5.
Figure 13:
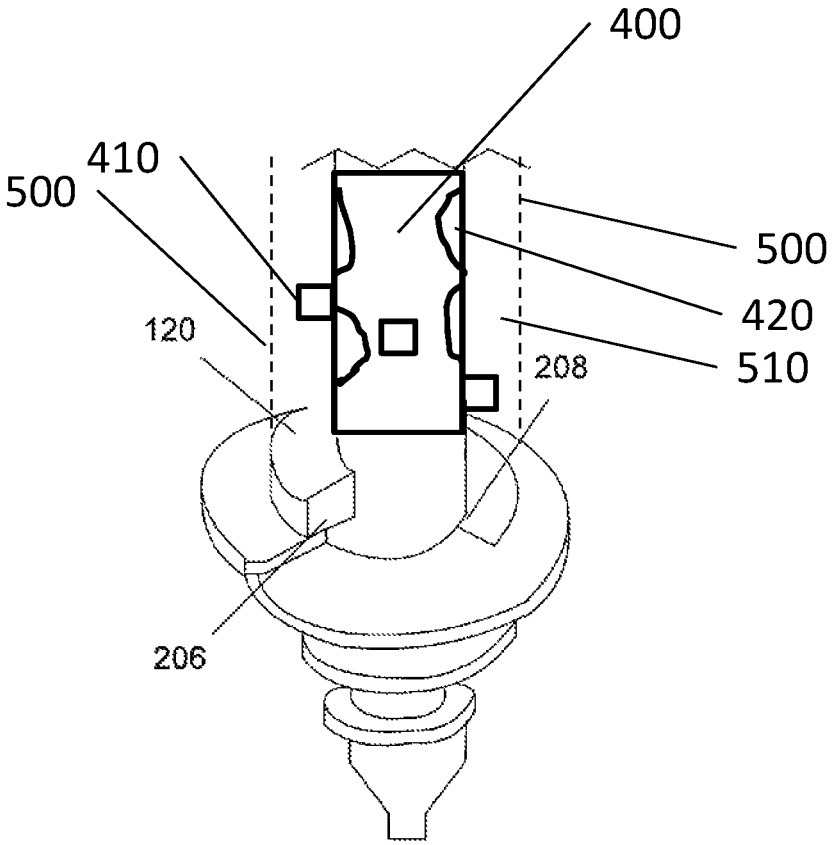

FIGS. 12 and 13 are side and perspective views of the bottom section of the pile of FIG. 5. The bottom section includes at least one lateral compaction element. In the embodiment shown in FIGS. 12 and 13, there are three such lateral compaction elements. The lateral compaction element 200 near the end of the pile has a diameter less than the diameter from the lateral compaction element 220 near deformation structure 120. The lateral compaction element 210 in the middle has a diameter that is between the diameters of the other two lateral compaction elements.

In this fashion, the soil is laterally compacted by the first lateral compaction element 200, more compacted by the second lateral compaction element 210 (enlarging the diameter of the bored hole) and even more compacted by the third lateral compaction element 220.

The helical blade 112 primarily cuts into the soil and only performs minimal soil compaction. The deformation structure 120 is disposed above the lateral compaction elements (200, 210, and 220). After the widest compaction element 200 has established an annulus with a regular diameter, deformation structure 120 cuts into the edge of the outer wall 500 of the annulus to leave a spiral pattern in the annulus's perimeter or circumference.

It is noted that, as illustrated in FIG. 13, the deformation structure 120 has a height that changes over the length of the deformation structure 120 from its greatest height at end 206 to a lesser height at end 208 as the deformation structure 120 coils about the pile in a helical configuration.

Figure 14:
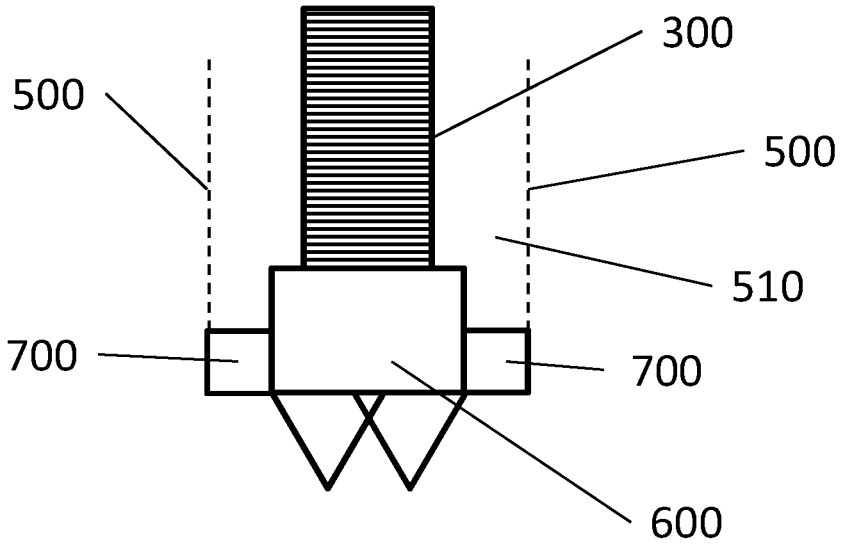
FIG. 14 illustrates another example of bottom section of the pile of FIG. 2.

FIG. 14 illustrates another example of a bottom section of the pile of FIG. 2. As illustrated in FIG. 14, the pile includes a threaded shaft 300.

It is noted that the threaded shaft 300 may be realized by including a single continuous raised helical thread (rib) on the outer surface of the shaft or a single continuous helical channel on the outer surface of the shaft. It is further noted that the threaded shaft 300 may be realized by including a plurality of raised rings, each raised ring encircling the outer surface of the shaft. It is also noted that the threaded shaft 300 may be realized by including a plurality of ringed channels, each ringed channel encircling the outer surface of the shaft.

The bottom section of the pile also includes a soil (medium) loosen bit or head 600 to loosen the soil (medium) around the pile as the pile is driven therein. The soil (medium) loosen bit or head 600 includes a lateral compaction structure 700 to laterally compact the loosen soil (medium) to create an annulus with an outer wall 500 and a void 510.

Figure 15:
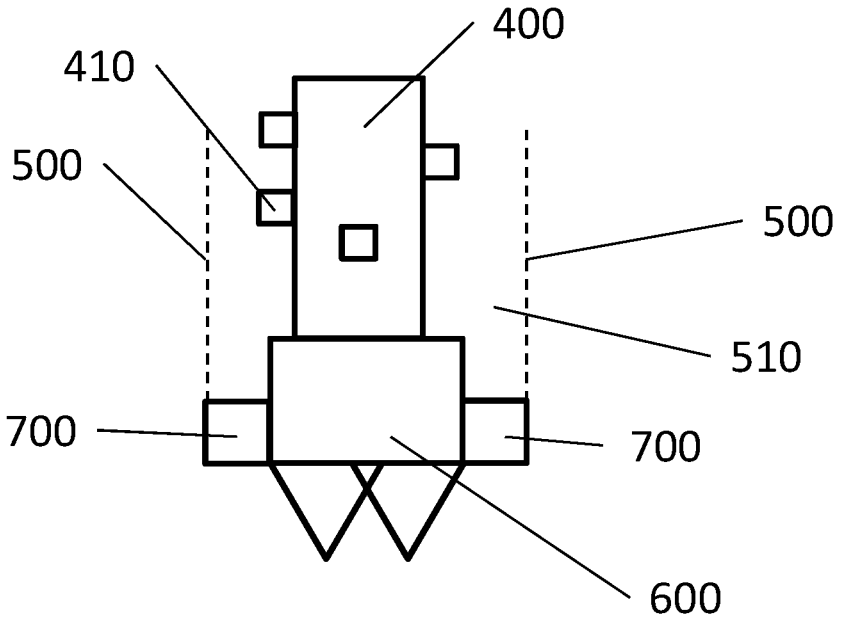
FIG. 15 illustrates another example of bottom section of the pile of FIG. 3.

FIG. 15 illustrates another example of a bottom section of the pile of FIG. 3. As illustrated in FIG. 15, the pile includes a plurality of projections (protrusions) 410 on the outer surface of a shaft 400.

The bottom section of the pile also includes a soil (medium) loosen bit or head 600 to loosen the soil (medium) around the pile as the pile is driven therein. The soil (medium) loosen bit or head 600 includes a lateral compaction structure 700 to laterally compact the loosen soil (medium) to create an annulus with an outer wall 500 and a void 510.

Figure 16:
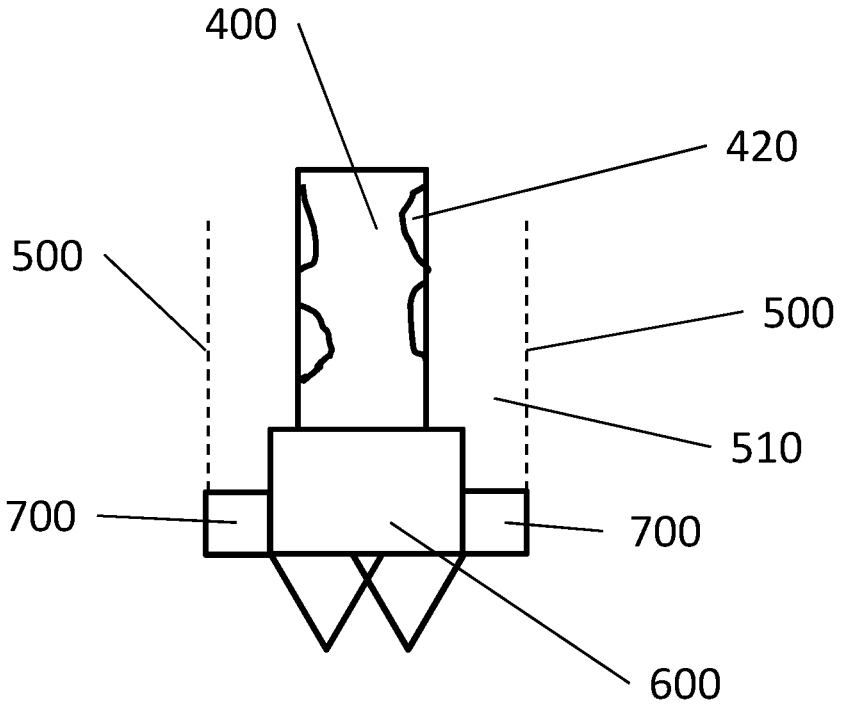
FIG. 16 illustrates another example of bottom section of the pile of FIG. 4.

FIG. 16 illustrates another example of a bottom section of the pile of FIG. 4. As illustrated in FIG. 16, the pile includes a plurality of indentations 420 on the outer surface of a shaft 400.

The bottom section of the pile also includes a soil (medium) loosen bit or head 600 to loosen the soil (medium) around the pile as the pile is driven therein. The soil (medium) loosen bit or head 600 includes a lateral compaction structure 700 to laterally compact the loosen soil (medium) to create an annulus with an outer wall 500 and a void 510.

Figure 17:
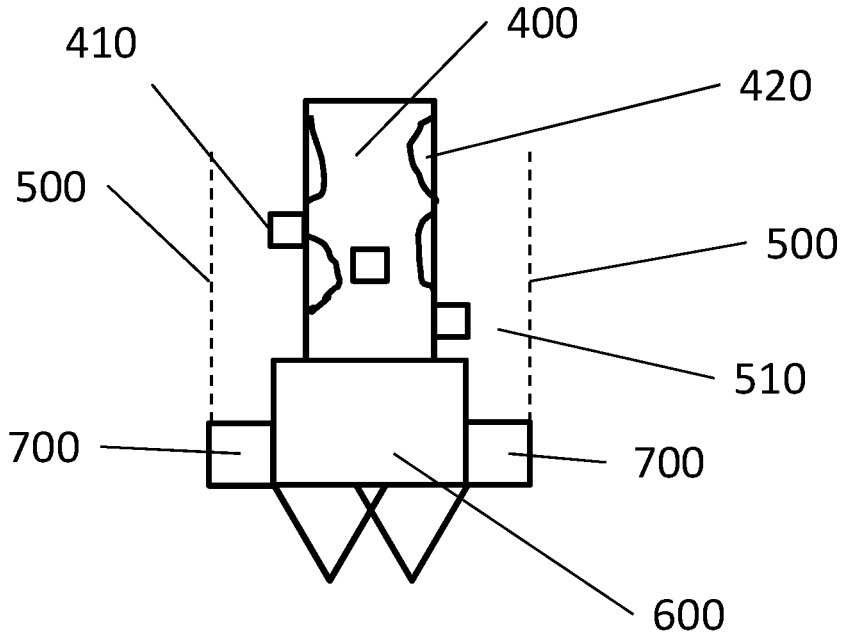
FIG. 17 illustrates another example of bottom section of the pile of FIG. 5.

FIG. 17 illustrates another example of a bottom section of the pile of FIG. 5. As illustrated in FIG. 17, the pile includes a plurality of projections (protrusions) 410 and a plurality of indentations 420 on the outer surface of a shaft 400.

The bottom section of the pile also includes a soil (medium) loosen bit or head 600 to loosen the soil (medium) around the pile as the pile is driven therein. The soil (medium) loosen bit or head 600 includes a lateral compaction structure 700 to laterally compact the loosen soil (medium) to create an annulus with an outer wall 500 and a void 510.

Figure 18:
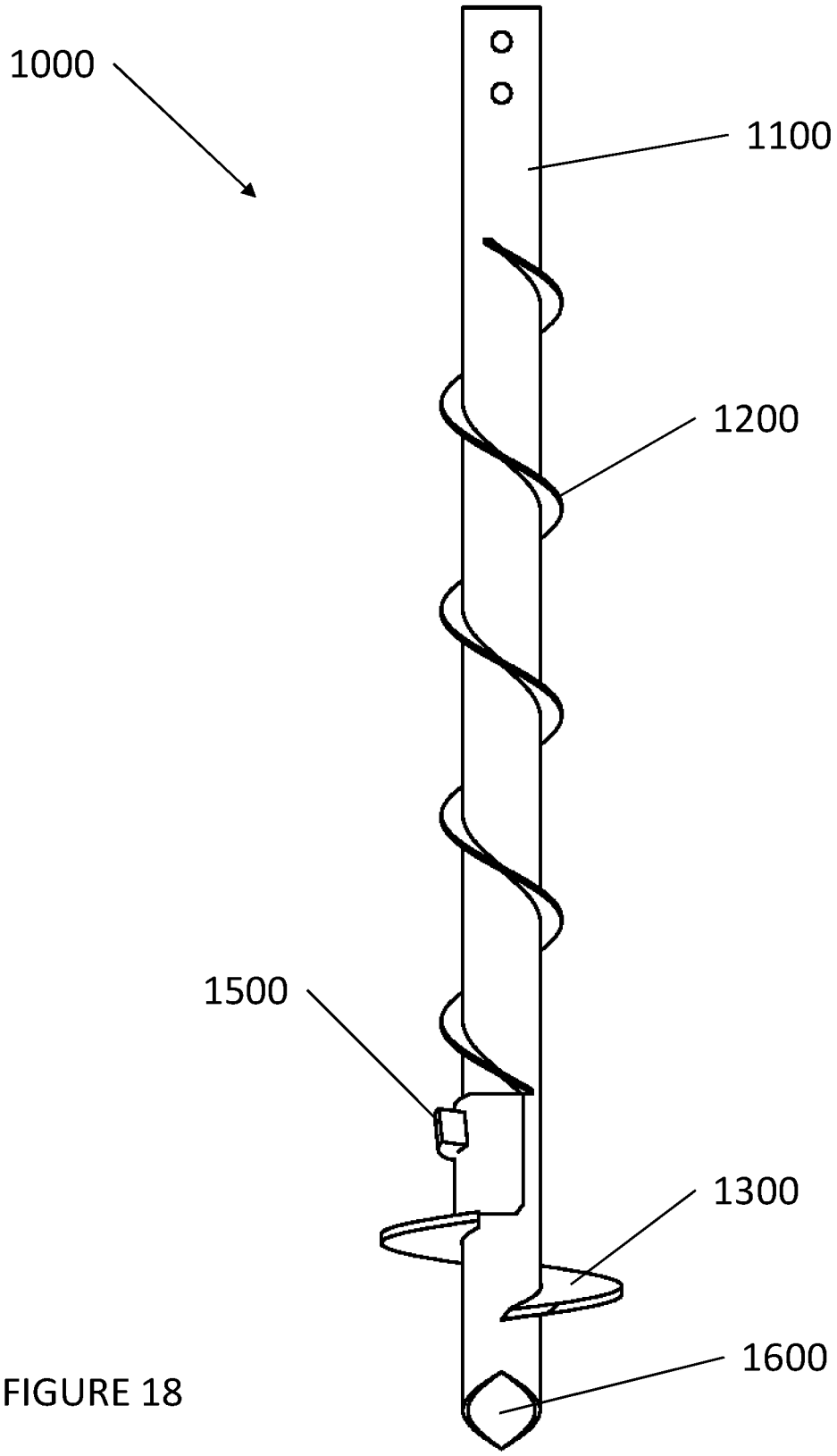
FIG. 18 illustrates a pile having an auger for providing gripping contact with a supporting medium or grout and resisting the supporting medium or grout from shearing.

FIG. 18 illustrates a pile 1000 that includes a shaft 1100. The pile 1000 includes an auger 1200. The pile 1000 has a blade 1300 that has a leading edge and a trailing edge. The leading edge of blade 1300 cuts into the soil as the pile 1000 is rotated. The pile 1000 may be equipped with a point 1600 to promote this cutting. The soil passes over blade 1300 and thereafter past trailing edge.

The pile 1000 includes a lateral compaction element 1500, located on the elongated, tubular pipe 1100 between the auger 1200 and the blade 1300. The lateral compaction element 1500 laterally compacts the loosen soil (medium) to form an annulus or core.

It is noted that auger 1200 provides a gripping interface between the supporting medium or grout and the shaft 1100, as well as, provide an interface that resists the supporting medium or grout from shearing along the surface between the supporting medium or grout and the shaft 1100.

Figure 19:
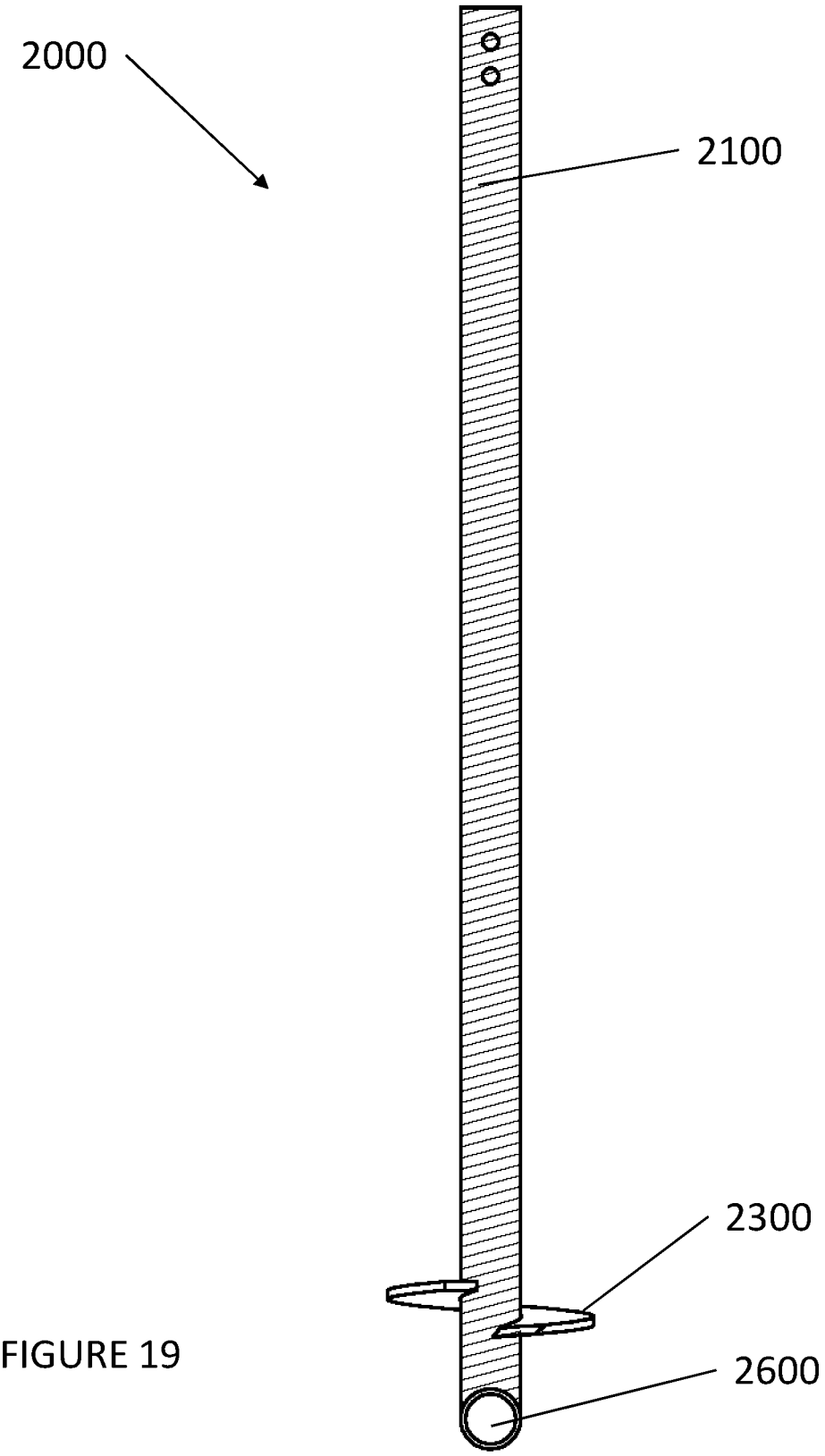
FIG. 19 illustrates another example of a pile for providing gripping contact with a supporting medium or grout and resisting the supporting medium or grout from shearing.

FIG. 19 illustrates a pile 2000 that includes a threaded shaft 2100. The pile 2000 has a blade 2300 that has a leading edge and a trailing edge. The leading edge of blade 2300 cuts into the soil as the pile 2000 is rotated. The pile 2000 may be equipped with a point 2600 to promote this cutting. The soil passes over blade 2300 and thereafter past trailing edge.

Figure 20:
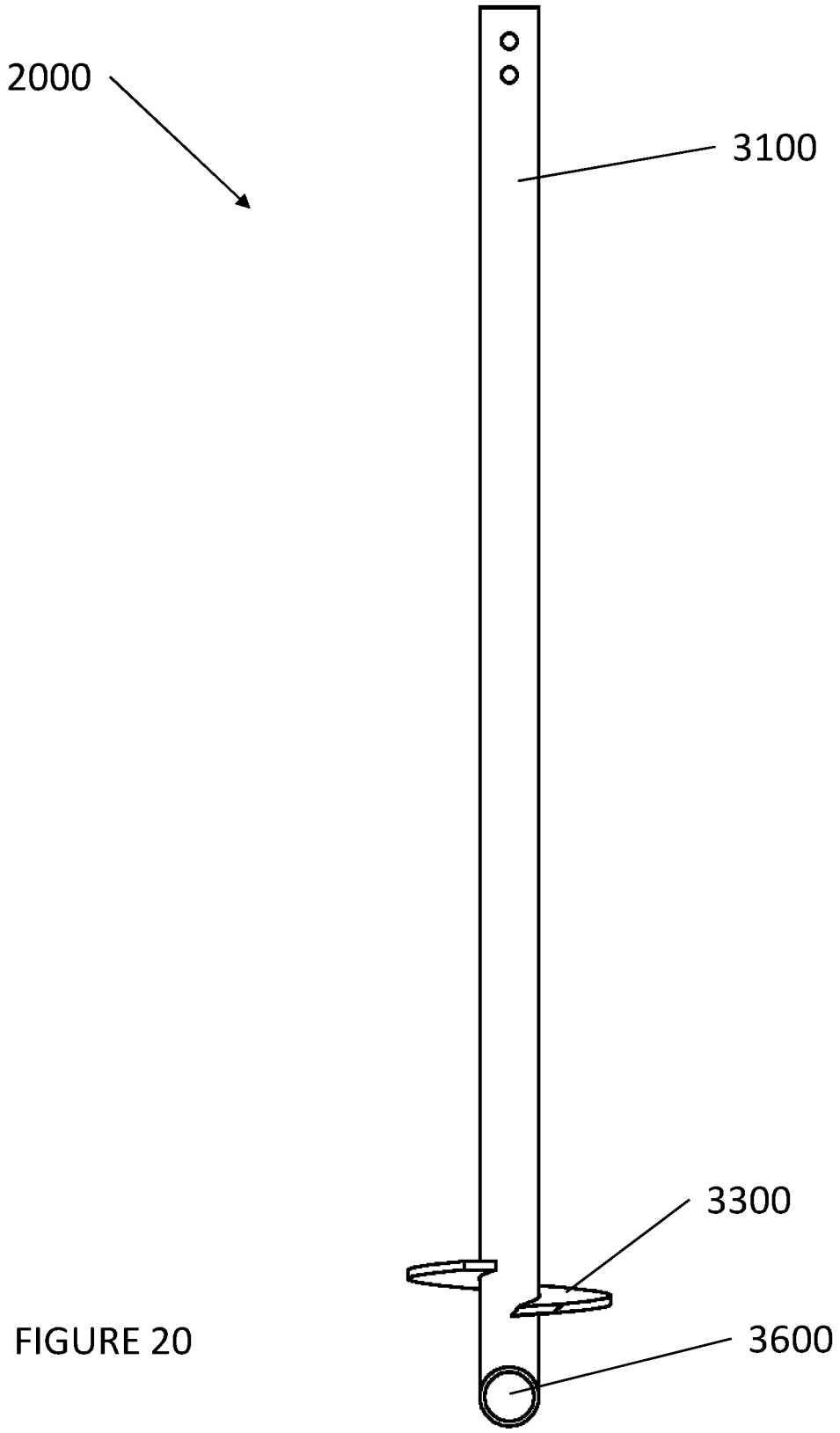
FIG. 20 illustrates a pile.

The threaded shaft 2100 provides a gripping interface between the supporting medium or grout and the threaded shaft 2100, as well as, provides an interface that resists the supporting medium or grout from shearing along the surface between the supporting medium or grout and the threaded shaft 2100. FIG. 20 illustrates a pile 3000 that includes a shaft 3100. The pile 3000 has a blade 3300 that has a leading edge and a trailing edge.

The leading edge of blade 3300 cuts into the soil as the pile 3000 is rotated. The pile 3000 may be equipped with a point 3600 to promote this cutting. The soil passes over blade 3300 and thereafter past trailing edge.

Figure 24:
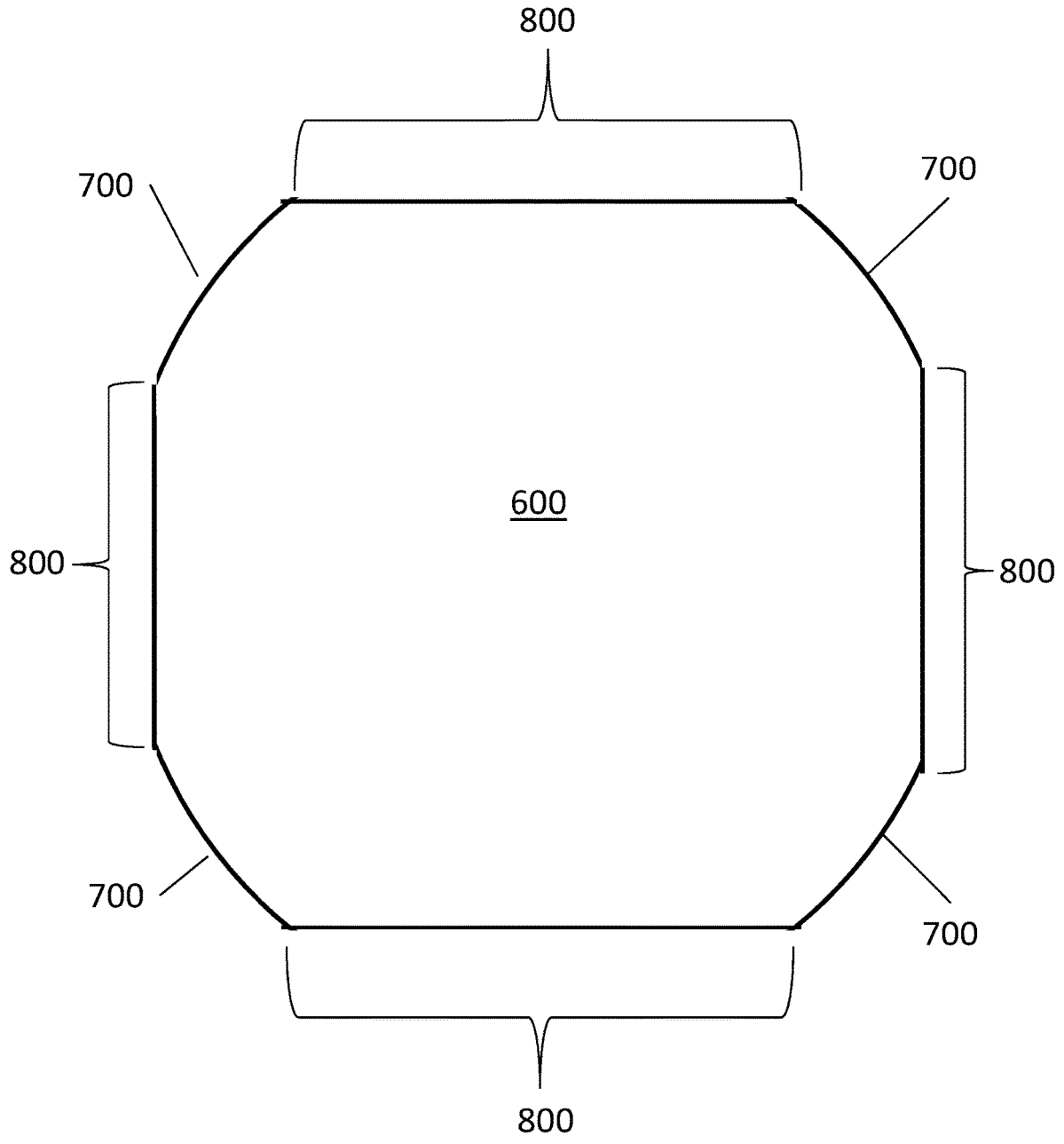
FIGURE 24 (PRIOR ART)
FIGS. 24 and 25 illustrate ASTM Specification gap measurements for prior art threaded bars.
Figure 25:
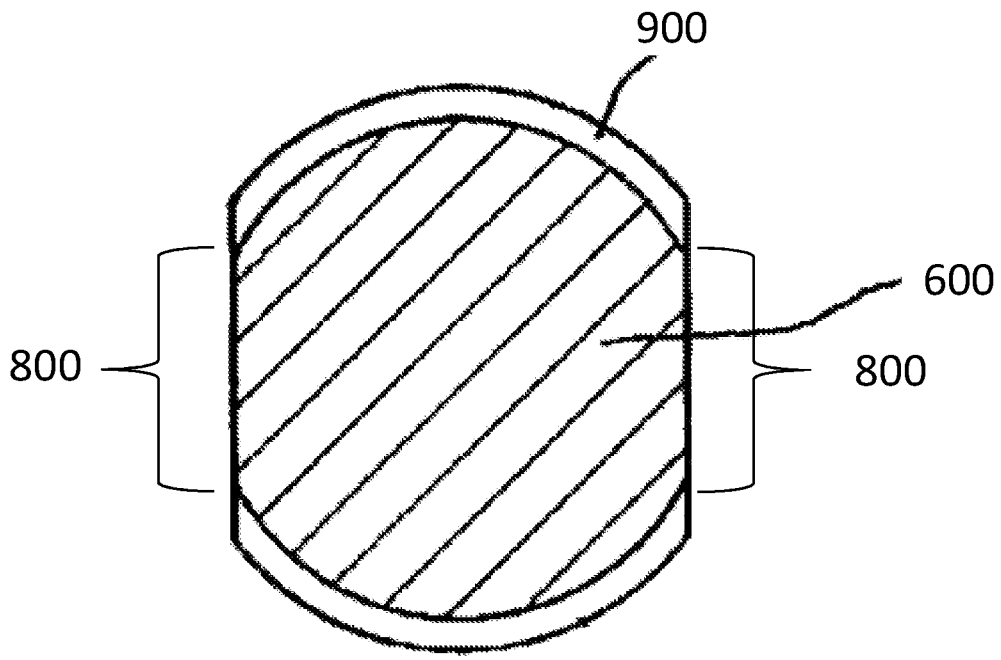
FIGURE 25 (PRIOR ART)

FIGS. 24 and 25 illustrate the cross-section of a shaft (bar) with threaded portions (deformations). More specifically, FIGS. 24 and 25 illustrate the shafts (bars) with threaded portions (deformations) as disclosed in U.S. Pat. No. 6,817,810. The entire content of U.S. Pat. No. 6,817,810 is hereby incorporated by reference.

As illustrated in FIG. 24, the shaft (bar) 600 includes rounded corners (deformations) 700. As further illustrated in FIG. 24, there is a gap 800 between each rounded corner (deformation) 700. As shown, the shaft (bar) 600 fails to meet ATSM Standard A615/A615M-20 because each gap 800 exceeds 12.5% of the nominal perimeter of the shaft (bar) 600. Moreover, the shaft (bar) 600 fails to meet ATSM Standard A615/A615M-20 because the summation of all the gaps 800 exceeds 25% of the nominal perimeter of the shaft (bar) 600. In other words, the shaft (bar), shown in FIG. 24 and disclosed in U.S. Pat. No. 6,817,810, fails to meet ATSM Standard A615/A615M-20 based upon the gap measurements.

As illustrated in FIG. 25, the shaft (bar) 600 includes rounded edges (deformations) 900. As further illustrated in FIG. 25, there is a gap 800 between each rounded edge (deformation) 900. As shown, the shaft (bar) 600 fails to meet ATSM Standard A615/A615M-20 because each gap 800 exceeds 12.5% of the nominal perimeter of the shaft (bar) 600. Moreover, the shaft (bar) 600 fails to meet ATSM Standard A615/A615M-20 because the summation of all the gaps 800 exceeds 25% of the nominal perimeter of the shaft (bar) 600. In other words, the shaft (bar), shown in FIG. 25 and disclosed in U.S. Pat. No. 6,817,810, fails to meet ATSM Standard A615/A615M-20 based upon the gap measurements.

Figure 23:
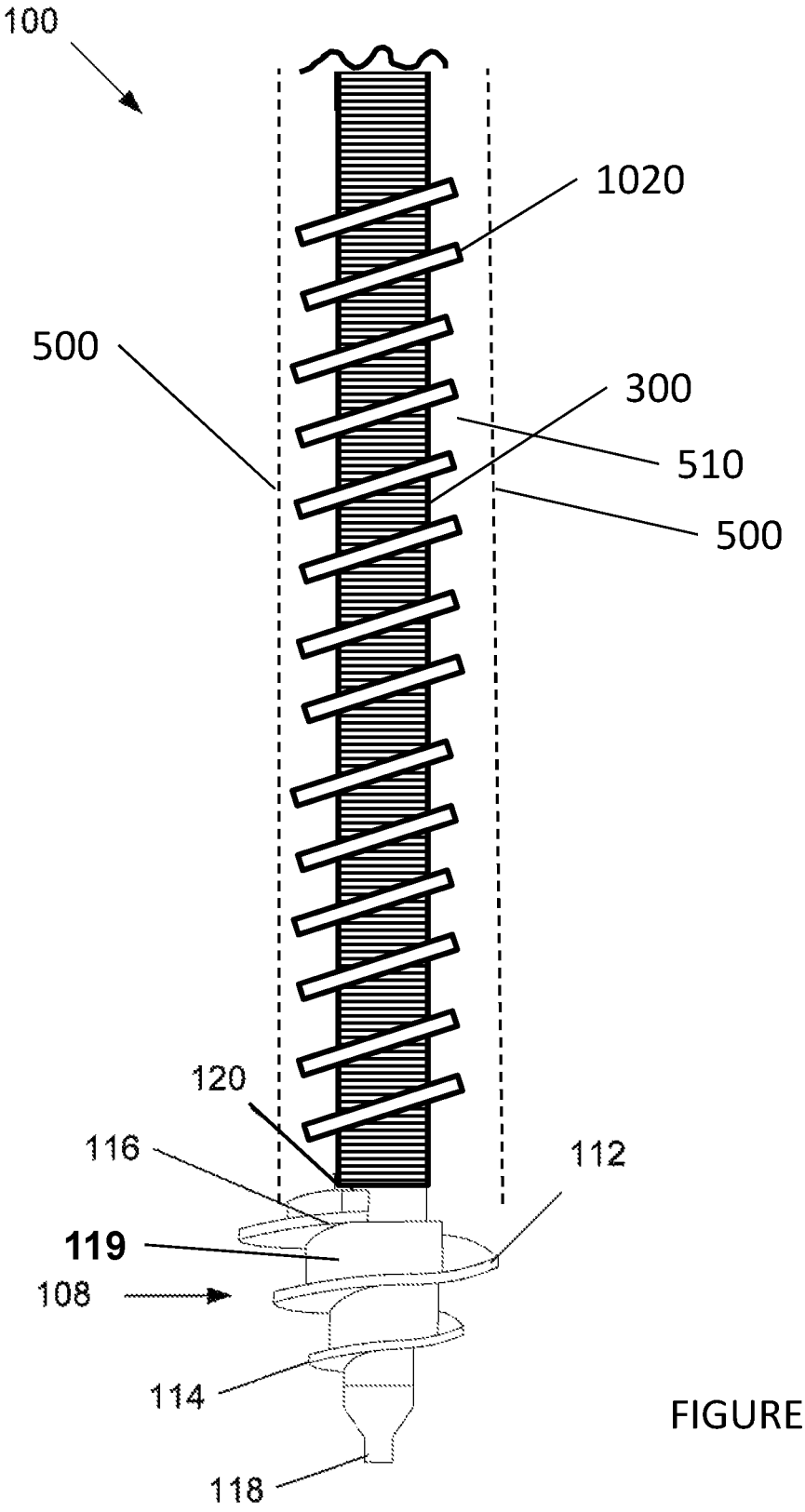
FIG. 23 illustrates an example of a pile using a threaded bar meeting ASTM Standards with helical plates.

An example of a pile for providing gripping contact with a supporting medium or grout and resisting the supporting medium or grout from shearing is illustrated in FIG. 23. More specifically, FIG. 23 is a schematic view of one embodiment of a pile.

As illustrated in FIG. 23, a pile 100 includes a threaded shaft 300. A bottom section of the pile 100 includes a soil (medium) displacement head 108. Soil (medium) displacement head 108 has a helical blade 112 that has a leading edge 114 and a trailing edge 116.

It is noted that the threaded shaft 300 may be realized by including a single continuous raised helical thread (rib) on the outer surface of the shaft or a single continuous helical channel on the outer surface of the shaft. The single continuous raised helical thread (rib) on the outer surface of the shaft or a single continuous helical channel on the outer surface of the shaft encircle the entire outer surface of the shaft so that there are no gaps as defined by ATSM Standard A615/A615M-20.

It is further noted that the threaded shaft 300 may be realized by including a plurality of non-helical parallel deformations, each non-helical parallel deformations encircling the entire outer surface of the shaft so that there are no gaps as defined by ATSM Standard A615/A615M-20.

It is additionally noted that the threaded shaft 300 may be realized by including a plurality of non-helical parallel raised rings, each raised ring encircling the entire outer surface of the shaft so that there are no gaps as defined by ATSM Standard A615/A615M-20.

It is also noted that the threaded shaft 300 may be realized by including a plurality of non-helical parallel ringed channels, each ringed channel encircling the entire outer surface of the shaft so that there are no gaps as defined by ATSM Standard A615/A615M-20.

A non-helical parallel deformation, a non-helical parallel raised ring, and/or a non-helical parallel ringed channel, as used in describing the threaded shaft 300, form a plane, wherein the plane, formed by the non-helical parallel deformation, non-helical parallel raised ring, and/or non-helical parallel ringed channel, is orthogonal, in two dimensions, to a central axis of the threaded shaft 300.

On the other hand, a helical deformation (continuous raised helical thread or continuous helical channel), as used in describing the threaded shaft 300, forms a plane, wherein the plane, formed by the helical deformation (continuous raised helical thread or continuous helical channel), is not orthogonal, in two dimension, to a central axis of the threaded shaft 300.

The threaded shaft 300 creates a deformed bar, which has gap measurements that are in accordance with ATSM Standard A615/A615M-20. The entire content of the ATSM Standard A615/A615M-20 is hereby incorporated by reference. In other words, the threaded shaft 300 creates a deformed bar which meets the maximum gap specifications of ATSM Standard A615/A615M-20 because the threaded shaft 300 has no gaps, as defined by ATSM Standard A615/A615M-20.

Moreover, the deformed bar, created by the threaded shaft 300, may meet some or all of the following ATSM Standards shown in Table 1 (FIG. 21) and/or Table 2 (FIG. 22): the maximum average spacing between the threads of the threaded shaft 300, and/or the minimum average height of the threads on the threaded shaft 300.

For example, if the physical characteristics of threaded shaft 300 classify the threaded shaft 300 as Bar Designation Number 10 in Table 2 (FIG. 22), the maximum average spacing between the threads of the threaded shaft 300 may be 0.276 inches, the minimum average height of the threads on the threaded shaft 300 may be 0.016 inches, and/or the maximum gap may be 0.151 inches. However, as noted above, since the threaded shaft 300 has no gaps, as defined by ATSM Standard A615/A615M-20, the threaded shaft 300 meets the maximum gap specification.

According to the ATSM Standard A615/A615M-20, the deformations shall be spaced along the bar at substantially uniform distances. The deformations on opposite sides of the bar shall be similar in size, shape, and pattern.

Moreover, according to the ATSM Standard A615/A615M-20, the deformations shall be placed with respect to the axis of the bar so that the included angle is not less than 45°. Where the line of deformations forms an included angle with the axis of the bar from 45 to 70° inclusive, the deformations shall alternately reverse in direction on each side, or those on one side shall be reversed in direction from those on the opposite side. Where the line of deformations is over 70°, a reversal in direction shall not be required.

Furthermore, according to the ATSM Standard A615/A615M-20, the average spacing or distance between deformations on each side of the bar shall not exceed seven tenths of the nominal diameter of the bar.

Additionally, according to the ATSM Standard A615/A615M-20, the overall length of deformations shall be such that the gap (measured as a chord) between the ends of the deformations shall not exceed 12.5% of the nominal perimeter of the bar. Where the ends terminate in a rib, the width of the rib shall be considered as the gap between these ends. The summation of the gaps shall not exceed 25% of the nominal perimeter of the bar. The nominal perimeter of the bar shall be 3.1416 times the nominal diameter.

The spacing, height, and gap of deformations shall conform to the requirements shown in Table 1 (FIG. 21) and Table 2 (FIG. 22).

The average spacing of deformations may be determined by measuring the length of a minimum of ten spaces and dividing that length by the number of spaces included in the measurement. The measurement may begin from a point on a deformation at the beginning of the first space to a corresponding point on a deformation after the last included space.

The average height of deformations may be determined from measurements made on not less than two typical deformations. Determinations may be based on three measurements per deformation, one at the center of the overall length and the other two at the quarter points of the overall length.

The threaded shaft 300 includes helical plates 1020 formed thereon. It is noted that although FIG. 23 illustrates multiple helical plates 1020, the threaded shaft 300 may only include a single helical plate or a continuous helical plate.

The helical plates 1020 formed on the threaded shaft 300 provide resistance to prevent the supporting medium or grout from shearing along the surface between the supporting medium or grout and the threaded shaft 300. The helical plates 1020 formed on the threaded shaft 300 also provide a stronger interface (gripping) between the supporting medium or grout and the threaded shaft 300.

The leading edge 114 of helical blade 112 cuts into the soil (medium) as the pile 100 is rotated. The soil (medium) displacement head 108 may be equipped with a point 118 to promote this cutting.

The soil (medium) passes over helical blade 112 and thereafter past trailing edge 116. As the soil (medium) passes over helical blade 112, the soil (medium) is laterally compacted by lateral compaction elements 119 (lateral compaction elements 200 are discussed in more detail below with respect to FIGS. 6, 8, 10, and 12). The lateral compaction elements 119 create an annulus having outer wall 500 and void 510.

The uppermost portion of helical blade 112 may include a deformation structure 120 (located near the trailing edge 116) that displaces the soil (medium) to create a spiral groove in the outer wall 500 of the annulus.

After the pile 100 is driven into position, supporting medium or grout (not shown) may be introduced into the void 510 of the annulus. The supporting medium or grout can be introduced by means of gravity or pressure into the void 510 of the annulus.

Additionally, since the pile 100 may be a hollow tube, the supporting medium or grout can be introduced into the void 510 of the annulus through the hollow tube by means of gravity or pressure, wherein the pile 100 would include openings (not shown) that allows the supporting medium or grout to leave the pile and enter into the void 510 of the annulus.

The introduced supporting medium or grout surrounds the threaded shaft 300 of the pile 100. The threaded surface of the threaded shaft 300 of the pile 100 provides a gripping interface between the supporting medium or grout and the pile 100, as well as, provides an interface that resists the supporting medium or grout from shearing along the surface between the supporting medium or grout and the pile 100.

In the various embodiments described above, the shaft may be a solid bar, a solid pipe, a hollow bar, or a hollow pipe. Moreover, in the various embodiments described above, the shaft may be round, rectangular, or square.

In the various embodiments described above, the supporting medium may be grout.

In the various embodiments described above, the embodiments are applicable to a displacement pile and/or a helical pile.

A pile includes a shaft and a soil displacement head, operatively connected to a first end of the shaft, having a helical blade with a leading edge and a trailing edge; the shaft having deformations formed thereon to provide a gripping interface between a supporting medium or grout and the pile.

The deformations may be threads. The threads may be formed on an entire length of the shaft.

The deformations may be a plurality of projections (protrusions) projecting away from the shaft. The deformations may be a plurality of indentations projecting into the shaft. The deformations may be a plurality of indentations projecting into the shaft and a plurality of projections (protrusions) projecting away from the shaft.

The pile may include a lateral compaction element, located within the helical blade to laterally compact a medium, as the pile is driven into the medium, to create an annulus in the medium. The pile may include a deformation structure disposed above the lateral compaction element to create a spiral deformation in an outer wall of the annulus.

A pile, includes a shaft and a medium loosen bit to loosen a medium around the pile as the pile is driven therein; the medium loosen bit including a lateral compaction structure to laterally compact the loosen medium to create an annulus; the shaft having deformations formed thereon to provide a gripping interface between a supporting medium or grout and the pile.

The deformations may be threads. The threads may be formed on an entire length of the shaft. The deformations may be a plurality of projections (protrusions) projecting away from the shaft. The deformations may be a plurality of indentations projecting into the shaft. The deformations may be a plurality of indentations projecting into the shaft and a plurality of projections (protrusions) projecting away from the shaft.

A pile includes a shaft and a helical blade, operatively connected to a first end of the shaft, having a leading edge and a trailing edge; the shaft having deformations formed thereon to provide a gripping interface between a supporting medium and the pile.

The deformations may be threads. The threads may be formed on an entire length of the shaft. The deformations may be a plurality of projections (protrusions) projecting away from the shaft. The deformations may be a plurality of indentations projecting into the shaft. The deformations may be a plurality of indentations projecting into the shaft and a plurality of projections (protrusions) projecting away from the shaft.

A pile includes a shaft and a soil displacement head, operatively connected to a first end of the shaft, having a helical blade with a leading edge and a trailing edge; the shaft having continuous deformations formed thereon to provide a gripping interface between a supporting medium and the shaft.

The continuous deformations may be a plurality of raised rings on a surface of the shaft. The continuous deformations may be a plurality of ringed channels on a surface of the shaft.

The plurality of raised rings may be formed on an entire length of the shaft. The plurality of ringed channels may be formed on an entire length of the shaft.

The pile may include a lateral compaction element, located within the helical blade to laterally compact a medium, as the pile is driven into the medium, to create an annulus in the medium.

The pile may include a deformation structure disposed above the lateral compaction element to create a spiral deformation in an outer wall of the annulus.

A pile includes a shaft and a medium loosen bit to loosen a medium around the pile as the pile is driven therein; the medium loosen bit including a lateral compaction structure to laterally compact the loosen medium to create an annulus; the shaft having a continuous helical structure formed thereon to provide a gripping interface between a supporting medium and the shaft.

A pile includes a shaft and a helical blade, operatively connected to a first end of the shaft, having a leading edge and a trailing edge; the shaft having a plurality of protrusions formed thereon to provide a gripping interface between a supporting medium and the shaft.

The shaft may further include a plurality of indentations projecting into the shaft.

A pile includes a shaft and a helical blade, operatively connected to a first end of the shaft, having a leading edge and a trailing edge; the shaft having a plurality of indentations randomly formed thereon to provide a gripping interface between a supporting medium and the shaft.

A pile, comprises a shaft; a soil displacement head, operatively connected to a first end of the shaft, having a helical blade with a leading edge and a trailing edge; and a lateral compaction element, located within the helical blade, to laterally compact a medium, as the pile is driven into the medium, to create an annulus in the medium; the soil displacement head creating an annulus in a medium; the shaft having a plurality of non-helical parallel deformations formed on the shaft to provide a gripping interface between a supporting medium, located within the annulus, and the shaft; each non-helical parallel deformation, formed on the shaft, fully encircling the shaft in a manner parallel to an adjacent non-helical parallel deformation formed on the shaft.

The plurality of non-helical parallel deformations may be a plurality of parallel raised rings on a surface of the shaft.

The plurality of non-helical parallel deformations may be a plurality of parallel ringed channels on a surface of the shaft.

The plurality of parallel raised rings may be formed on an entire length of the shaft.

The plurality of parallel ringed channels may be formed on an entire length of the shaft.

The pile may further comprise a deformation structure, disposed above the lateral compaction element, to create a spiral deformation in an outer wall of the annulus.

A pile comprises a shaft; and a soil displacement head, operatively connected to a first end of the shaft, having a lateral compaction element to laterally compact a medium, as the pile is driven into the medium, to create an annulus in the medium; the shaft having a plurality of protrusions formed on the shaft to provide a gripping interface between a supporting medium, located within the annulus, and the shaft; the plurality of protrusions projecting from the shaft to increase a surface area of the shaft; the plurality of protrusions projecting from the shaft without contacting the annulus created by the lateral compaction element; the plurality of protrusions having a maximum average spacing of less than 2 inches; the shaft further including a plurality of indentations formed on the shaft.

The shaft may have a plurality of indentations formed on the shaft to provide a gripping interface between a supporting medium, located within the annulus, and the shaft; the plurality of indentations projecting into the shaft to increase a surface area of the shaft.

The pile may further comprise a deformation structure, disposed above the lateral compaction element, to create a spiral deformation in an outer wall of the annulus; the soil displacement head including a helical blade having a leading edge and a trailing edge; the lateral compaction element being located within the helical blade.

The protrusions may be randomly formed on the shaft.

A pile comprises a shaft; and a soil displacement head, operatively connected to a first end of the shaft, having a lateral compaction element to laterally compact a medium, as the pile is driven into the medium, to create an annulus in the medium; the shaft having a plurality of indentations formed on the shaft to provide a gripping interface between a supporting medium, located within the annulus, and the shaft, each indentation having a solid bottom surface; the plurality of indentations projecting into the shaft to increase a surface area of the shaft; the plurality of indentations having a maximum average spacing of less than 2 inches.

The pile may further comprise a deformation structure, disposed above the lateral compaction element, to create a spiral deformation in an outer wall of the annulus; the soil displacement head including a helical blade having a leading edge and a trailing edge; the lateral compaction element being located within the helical blade.

A pile comprises: a shaft; a soil displacement head, operatively connected to a first end of the shaft, having a helical blade with a leading edge and a trailing edge; and a lateral compaction element, located within the helical blade, to laterally compact a medium, as the pile is driven into the medium, to create an annulus in the medium; the soil displacement head creating an annulus in a medium; the shaft having a plurality of non-helical parallel deformations formed on the shaft to provide a gripping interface between a supporting medium, located within the annulus, and the shaft; each non-helical parallel deformation, formed on the shaft, fully encircling the shaft in a manner parallel to an adjacent non-helical parallel deformation formed on the shaft; the non-helical parallel deformations being configured in conformance with a maximum gap specification of ATSM Standard A615/A615M-20.

A pile comprises a shaft; and a soil displacement head, operatively connected to a first end of the shaft, having a lateral compaction element to laterally compact a medium, as the pile is driven into the medium, to create an annulus in the medium; the shaft having a plurality of protrusions formed on the shaft to provide a gripping interface between a supporting medium, located within the annulus, and the shaft; the plurality of protrusions projecting from the shaft to increase a surface area of the shaft; the plurality of protrusions projecting from the shaft without contacting the annulus created by the lateral compaction element; the plurality of protrusions being configured in conformance with a maximum gap specification of ATSM Standard A615/A615M-20.

A pile comprises a shaft; and a soil displacement head, operatively connected to a first end of the shaft, having a lateral compaction element to laterally compact a medium, as the pile is driven into the medium, to create an annulus in the medium; the shaft having a plurality of indentations formed on the shaft to provide a gripping interface between a supporting medium, located within the annulus, and the shaft, each indentation having a solid bottom surface; the plurality of indentations projecting into the shaft to increase a surface area of the shaft; the plurality of indentations being configured in conformance with a maximum gap specification of ATSM Standard A615/A615M-20.

It will be appreciated that several of the above-disclosed embodiments and other features and functions, or alternatives thereof, may be desirably combined into many other different systems or applications. Also, various presently unforeseen or unanticipated alternatives, modifications, variations, or improvements therein may be subsequently made by those skilled in the art which are also intended to be encompassed by the claims.

What is claimed is:

1. A pile comprising: a shaft; a soil displacement head, operatively connected to a first end of said shaft, having a helical blade with a leading edge and a trailing edge; and a lateral compaction element, located within said helical blade, to laterally compact a medium, as the pile is driven into the medium, to create an annulus in the medium; said soil displacement head creating an annulus in a medium; said shaft having a plurality of non-helical parallel deformed bar deformations formed on said shaft to provide a gripping interface between a supporting medium, located within the annulus, and said shaft; each non-helical parallel deformed bar deformation, formed on said shaft, fully encircling said shaft in a manner parallel to an adjacent non-helical parallel deformed bar deformation formed on said shaft; said non-helical parallel deformed bar deformations being configured in conformance with a maximum gap specification of ATSM Standard A615/A615M-20.

2. The pile, as claimed in claim 1, wherein said non-helical parallel deformed bar deformations are a plurality of parallel raised rings on a surface of said shaft.

3. The pile, as claimed in claim 2, wherein said parallel raised rings is formed on an entire length of said shaft.

4. The pile, as claimed in claim 2, further comprising:

a deformation structure, disposed above said lateral compaction element, to create a spiral deformation in an outer wall of the annulus.

5. The pile, as claimed in claim 1, wherein said non-helical parallel deformed bar deformations are a plurality of parallel ringed channels on a surface of said shaft.

6. The pile, as claimed in claim 1, further comprising:

a deformation structure, disposed above said lateral compaction element, to create a spiral deformation in an outer wall of the annulus.

7. The pile, as claimed in claim 5, further comprising:

a deformation structure, disposed above said lateral compaction element, to create a spiral deformation in an outer wall of the annulus.

8. The pile, as claimed in claim 5, wherein said parallel ringed channels is formed on an entire length of said shaft.

9. A pile comprising: a shaft; and a soil displacement head, operatively connected to a first end of said shaft, having a lateral compaction element to laterally compact a medium, as the pile is driven into the medium, to create an annulus in the medium; said shaft having a plurality of deformed bar protrusions formed on said shaft to provide a gripping interface between a supporting medium, located within the annulus, and said shaft; said plurality of deformed bar protrusions projecting from said shaft to increase a surface area of said shaft; said plurality of deformed bar protrusions projecting from said shaft without contacting the annulus created by said lateral compaction element; said plurality of deformed bar protrusions being configured in conformance with a maximum gap specification of ATSM Standard A615/A615M-20.

10. The pile, as claimed in claim 9, wherein said shaft has a plurality of indentations formed on said shaft to provide a gripping interface between a supporting medium, located within the annulus, and said shaft;

said plurality of indentations projecting into said shaft to increase a surface area of said shaft.

11. The pile, as claimed in claim 9, further comprising:

a deformation structure, disposed above said lateral compaction element, to create a spiral deformation in an outer wall of the annulus;

said soil displacement head including a helical blade having a leading edge and a trailing edge;

said lateral compaction element being located within said helical blade.

12. The pile, as claimed in claim 9, wherein said deformed bar protrusions are randomly formed on said shaft.

13. A pile comprising: a shaft; and a soil displacement head, operatively connected to a first end of said shaft, having a lateral compaction element to laterally compact a medium, as the pile is driven into the medium, to create an annulus in the medium; said shaft having a plurality of deformed bar indentations formed on said shaft to provide a gripping interface between a supporting medium, located within the annulus, and said shaft, each deformed bar indentation having a solid bottom surface; said plurality of deformed bar indentations projecting into said shaft to increase a surface area of said shaft; said plurality of deformed bar indentations being configured in conformance with a maximum gap specification of ATSM Standard A615/A615M-20.

14. The pile, as claimed in claim 13, further comprising:

a deformation structure, disposed above said lateral compaction element, to create a spiral deformation in an outer wall of the annulus;

said soil displacement head including a helical blade having a leading edge and a trailing edge;

said lateral compaction element being located within said helical blade.

* * * * *